US007363795B2

(12) United States Patent
Akahane et al.

(10) Patent No.: US 7,363,795 B2
(45) Date of Patent: Apr. 29, 2008

(54) GUIDED PUNCHING APPARATUS

(75) Inventors: Fujio Akahane, Nagano (JP); Nagamitsu Takashima, Nagano (JP); Kazushige Hakeda, Nagano (JP); Ryoji Uesugi, Nagano (JP); Akiharu Kurebayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 60 days.

(21) Appl. No.: 10/647,668

(22) Filed: Aug. 25, 2003

(65) Prior Publication Data

US 2004/0150689 A1 Aug. 5, 2004

(30) Foreign Application Priority Data

Aug. 23, 2002 (JP) ..... P2002-243480
Aug. 12, 2003 (JP) ..... P2003-292468

(51) Int. Cl.
*B21D 28/26* (2006.01)

(52) U.S. Cl. ..... 72/334; 72/414; 83/691; 29/896.6

(58) Field of Classification Search ..... 72/414, 72/385, 333–335, 472; 83/687, 691, 133, 83/143, 821; 29/896.6
See application file for complete search history.

(56) References Cited

U.S. PATENT DOCUMENTS 1,325,194 A * 12/1919 Geist ..... 72/335
1,815,344 A * 7/1931 Brincil ..... 29/898.056
2,108,619 A * 2/1938 Smith ..... 83/133
2,309,942 A * 2/1943 Ekstedt et al. ..... 72/335
2,825,407 A * 3/1958 Widell ..... 83/687
3,125,917 A * 3/1964 Smeets ..... 83/140
4,993,295 A * 2/1991 Dacey, Jr. ..... 83/140
5,161,403 A * 11/1992 Kitchens ..... 72/414
5,836,226 A * 11/1998 Tsuji et al. ..... 83/129
5,857,397 A 1/1999 Matsubayashi et al.
6,408,728 B1 * 6/2002 Tsuji et al. ..... 83/687
6,499,836 B1 12/2002 Usui et al.
6,688,201 B1 * 2/2004 Dokyu et al. ..... 83/206
2003/0029038 A1 2/2003 Usui et al.
2005/0057616 A1 3/2005 Usui et al.

FOREIGN PATENT DOCUMENTS

CN 1157204 A 8/1997
JP 59-066935 A 4/1984
JP 03-264139 A 11/1991
JP 04-284925 A 10/1992
JP 07-032063 A 2/1995
JP 10-296350 A 11/1998
JP 2000-263799 A 9/2000

* cited by examiner

*Primary Examiner*—Daniel C Crane
(74) *Attorney, Agent, or Firm*—Sughrue Mion, PLLC

(57) ABSTRACT

A male die is adapted to be opposed to a first face of a metallic plate member. The male die includes a plurality of punches which are provided on the male die and arranged side by side in a first direction with a fixed pitch. A guide member is formed with a guide face which supports a side portion of the male die, at least when the punches are pressed into the plate member in a second direction, to form through holes therein.

31 Claims, 21 Drawing Sheets

GUIDED PUNCHING APPARATUS

BACKGROUND OF THE INVENTION

The present invention relates to a method of punching a circular or rectangular minute hole having a diameter or a long side of not greater than about 0.5 mm at a metal board by using an upper die and a lower die. The present invention also relates to a method and an apparatus for manufacturing a liquid ejection head using such a punching method.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber. Such a structure is disclosed in Japanese Patent Publication No. 2000-263799A.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

Further, each of the pressure generating chambers needs to be bored with a communication port for communicating the pressure generating chamber and the nozzle orifice. However, the pressure generating chambers need to be aligned with a number of slender small elongated recess portions at a small pitch and with regard to the communication port, a number of small holes each having a small opening dimension need to align at bottom portions of the elongated recess portions at a small pitch. Therefore, the working is extremely difficult and the working with high accuracy is difficult to thereby pose a problem that improvement of production efficiency is difficult to achieve.

SUMMARY OF THE INVENTION

It is therefore an object of the invention to provide a punching method capable of forming a minute hole by the plastic working with excellent accuracy. It is also an object of the invention to provide a method and an apparatus for manufacturing a liquid ejection head using such a punching method.

In order to achieve the above objects, according to the invention, there is provided a punching apparatus, comprising:

a male die, adapted to be opposed to a first face of a metallic plate member, the male die including a plurality of punches which are provided on the male die and arranged side by side in a first direction with a fixed pitch; and a guide member, formed with a guide face which supports a side portion of the male die, at least when the punches are pressed into the plate member in a second direction, to form through holes therein.

With such a configuration, bending or escaping of the punches due to stresses produced by working is prevented, shape, dimensional and alignment accuracy of each minute hole can be enhanced. Further, wear or damage of the punches can significantly be reduced, tool life can significantly be prolonged, so that accuracy of the minute hole can be maintained over a long time period.

Preferably, the side portion of the male die extends in parallel with the first direction. Since the punches are more liable to be bent or escaped in the direction substantially orthogonal to the first direction, by restraining displacement of the punches by the guide member, bending or escape of the punches is surely prevented.

Preferably, the punches are arranged on a base member which is actuated so as to collectively press the punches into the plate member. In this case, the punching work can be carried out efficiently with high accuracy.

It is preferable that: each of the punches has a polygonal cross section including two sides which are parallel to the first direction; and side faces of each of the punches corresponding to the two sides are supported by the guide member. In this case, the shape of the guide member can be simplified while ensuring the guiding effect. Therefore, total working cost can be reduced.

Preferably, each of the punches has a rectangular cross section. In this case, three or four-directional guidance can be established as described later.

Here, it is preferable that the guide member is formed with projections which support at least one side face of each of the punches which faces a gap defined between adjacent punches. In this case, since the male die can be guided at least from three directions, bending or escaping of the punches in the midst of working can significantly be restrained.

It is further preferable that the projections are arranged such that two adjacent punches are placed between two adjacent projections. In this case, since a number of the projections formed at the guide member can be reduced while ensuring the three-directional guidance, the working cost of the guide member can be reduced.

It is further preferable that the projections are arranged such that at least one projection is placed between a gap defined between the two adjacent punches. In this case, since the projections are arranged at the respective gaps between the punches, four-directional guidance for each punch can be ensured so that bending or escaping of the punches in the midst of working can be further restrained.

Preferably, the guide face and the projections are formed by grinding work. In this case, since the grinding work is relatively inexpensive working means, the working cost of the guide member can be reduced. Further, the projections can be worked with high working accuracy.

Preferably, the male die includes a first die for forming unpenetrated holes in the first face of the plate member, and a second die for punching the unpenetrated holes to form through holes communicated with a second face of the plate member which is opposite to the first face. In this case, upon forming the unpenetrated holes, a drawback that the metal material is excessively pulled downward can be prevented, so that the unpenetrated hole can be formed with excellent dimensional accuracy without deteriorating the contiguous minute hole or the working shape.

It is preferable that: the fixed pitch is 0.3 mm or less; a width of the hole is 0.2 mm or less; and a ratio of a distance between the first face and the second face with respect to a width of the hole is 0.5 or more. Even in such cases that the minute holes aligned at a small pitch, which are relatively difficult to work with high accuracy, can be worked efficiently with high accuracy without deteriorating the contiguous minute hole or the working shape.

Preferably, the first face is a portion of the plate member which has been subjected to a plastic working. In the portion subjected to the plastic working, since the hardness of the material is increased so that workability is deteriorated, it is more difficult to increase accuracy and die life. However, by preventing bending or escaping of the punches, the advantage of the invention is remarkable in such a condition.

Here, it is preferable that the portion is a bottom face of a recess; and the bottom face is a slope face. In this case, the distal end portion of the punch is pressed to the slope face at the initial stage of the working so that large bending moment is act on the punch. However, since the punches are guided by the guide member, the bending moment can firmly be received by the guide member so that the through hole can be formed even in such a case. Further, the punch is accurately pressed into the slope face, and the material flow smoothly accompanies with the punch. Therefore, burrs projecting into the recess portion can be prevented from being formed. In a case where the obtained plate member is incorporated in the flow path unit of a liquid ejection head, bubbles in liquid flow will not stay in the flow path so that the ejection property of the liquid ejection head can normally be maintained.

Preferably, the punches are adapted to be pressed into the plate member comprised of nickel. Since nickel is rich in ductility, it assists the punching work high dimensional accuracy.

Preferably, the guide member is arranged movably in the second direction. Here, the guide member is formed with a first face, a second face, and a through hole which communicates the first face and the second face. The male die is inserted from an opening of the though hole at the first face, and allowed to move therein in the second direction. An inner face of the through hole serves as the guide face.

In this case, since the inner face has a high rigidity which can withstand large load, the stable guiding function can be carried out. Further, since the guide face can be ensured immediately by forming the through hole, the guide face can be provided by a simple constitution.

Here, it is preferable that the second face of the guide member is brought into contact with the plate member, so that the punches are projected from an opening of the through hole at the second face when the through holes are formed. In this case, even in a case where the press length of the punches to the plate member is prolonged, since the guide member is brought into close contact with the plate member, the guiding function of the guide member is achieved at a location as proximate as possible to the portion of generating stresses produced by the punching working, so that the bending or escape of the punches by the working stresses can be surely prevented.

It is further preferable that the guide member is arranged such that distal end face of the punches and the second face of the guide member are made flush with each other, before the second face is brought into contact with the plate member. In this case, the relative positions between the punches and the guide member before starting the punching work can be set without abnormally projecting the punches from the guide member toward the plate member.

Preferably, the punching apparatus further comprises a fixation member, to which the male die is fixed. Here, the base member includes a first part integrated with the punches, and a second part continued from the first part and fixed at the fixation member. The first part has a higher rigidity than a rigidity of the punches and a first cross sectional area in parallel with the first direction which is larger than a total cross sectional area in parallel with the first direction of the punches. The second part has a second cross sectional area in parallel with the first direction which is larger than the first cross sectional area.

In this case, since the rigidity is gradually increased toward the fixed side, stresses are not abnormally concentrated at a specific location of the male die when the punches are actuated, so that the durability of the total structure of the male die can be enhanced. Further, the rigidity of attaching the male die to the fixation member can be stabilized so that durability sufficient for frequent punching work.

Here, it is preferable that the guide member supports the first part of the base member. In this case, only a length of the punch required for realizing the punching work may be ensured without ensuring a length required for guiding. Therefore, the length of the punches can substantially be shortened and rigidity against bending or escape or the like of the punches per se can be enhanced.

It is also preferable that the fixation member is formed with a retainer which restricts a movement of the second part of the base member in the second direction. Particular when the punches pressed into the material is withdrawn, it is necessary to transmit large withdrawing force from the fixation member to the male die. In such a case, since the second part of the base member is firmly held by the fixation member, the male die and the fixation member can be withdrawn with firm integrity, so that a punching apparatus having excellent operational stability can be provided.

According to the invention, there is also provided a plate member manufactured by the above punching apparatus.

According to the invention, there is also provided a liquid ejection head incorporating the above plate member, comprising:

a sealing plate, joined to the plate member so as to seal the recess to form a pressure generating chamber; and a metallic nozzle plate, formed with a plurality of nozzles and joined to the plate member such that each of the nozzles is communicated with associated one of the through hole, wherein liquid droplets are ejected from the nozzles by pressure fluctuation generated in liquid contained in the pressure generating chamber.

Since the plate member to be a chamber formation plate can be finished with excellent accuracy by the above punching work, an excellent ejection property of the liquid injecting head can be achieved such that flow path resistance of ejected liquid is reduced by increasing plane accuracy of an inner face of the through hole to be nozzle communicating port.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
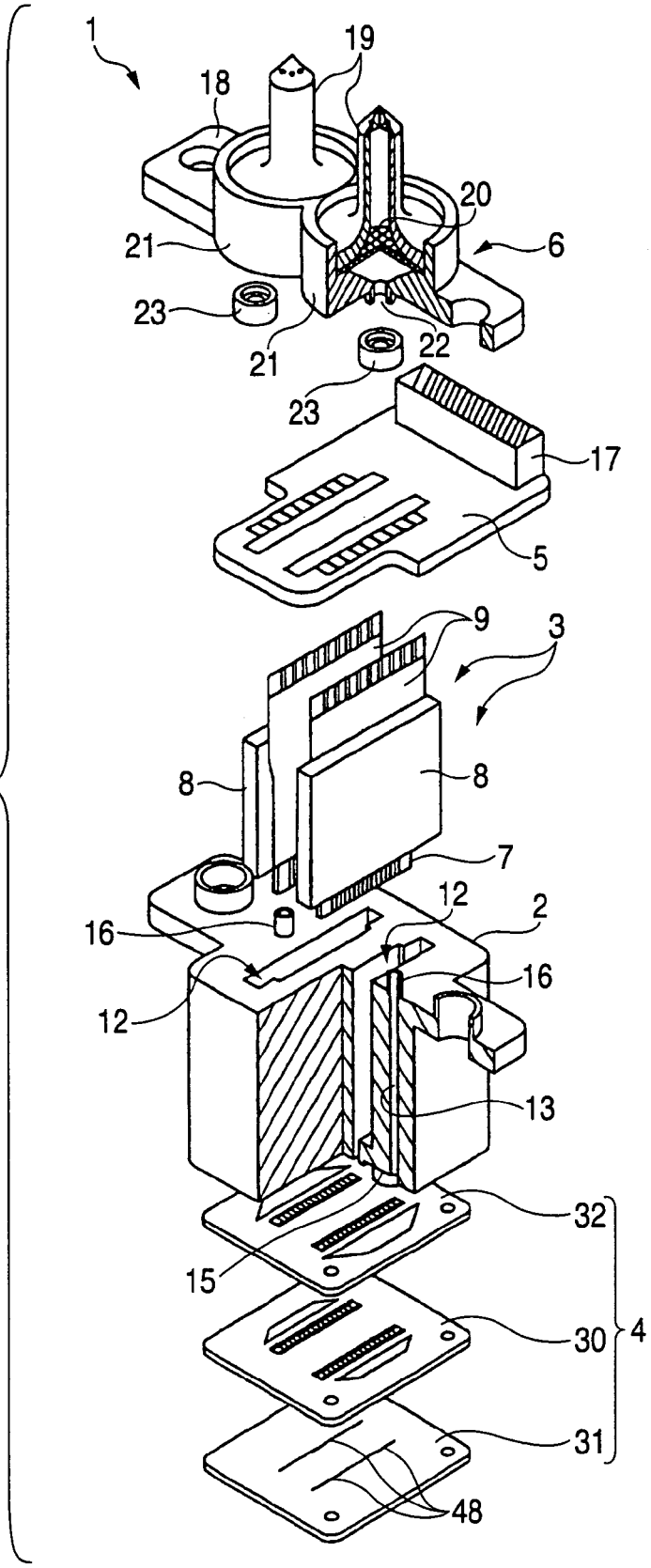
FIG. 1 is a perspective view of a disassembled ink jet recording head according to a first example.
Figure 2:
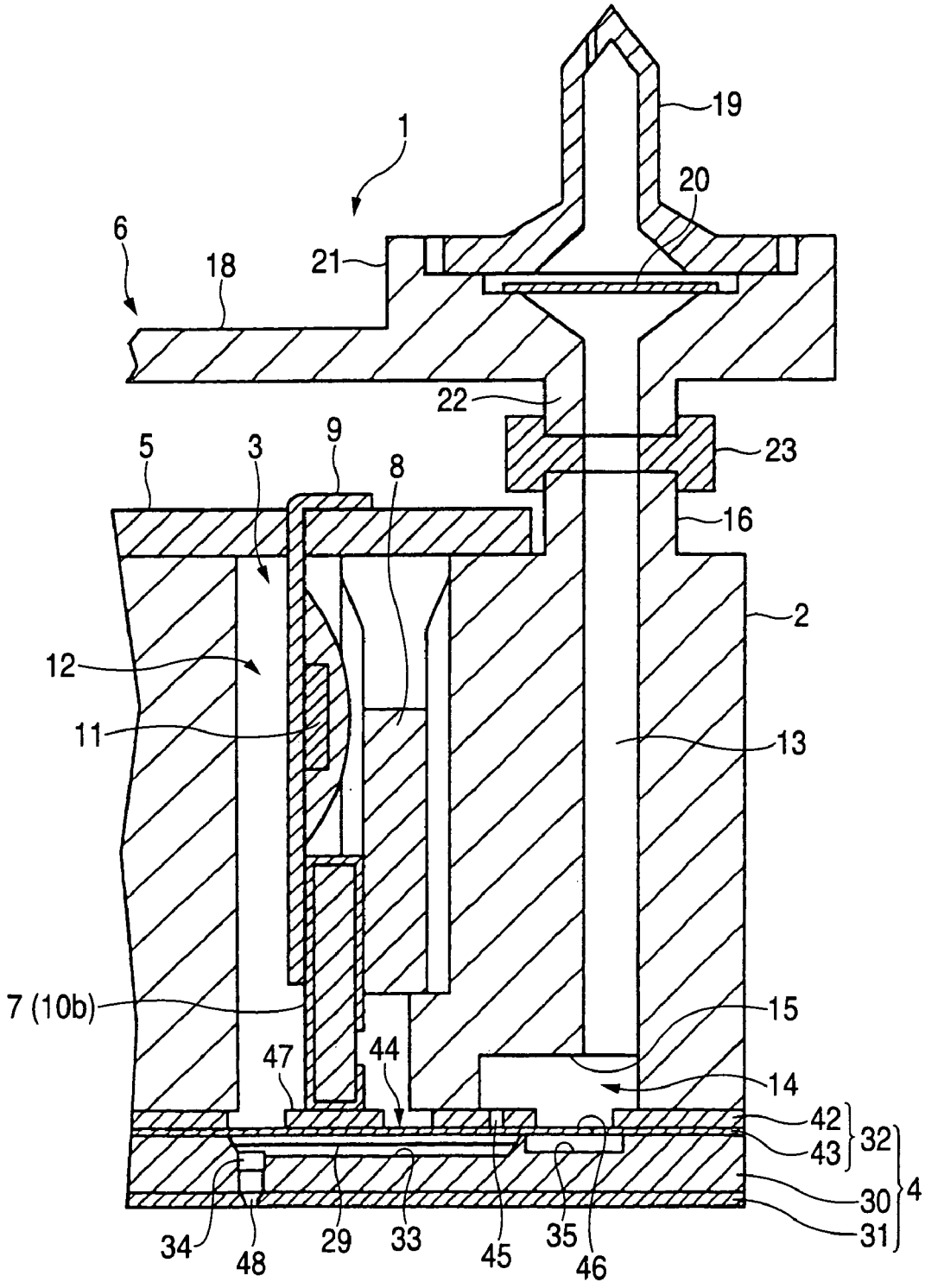
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
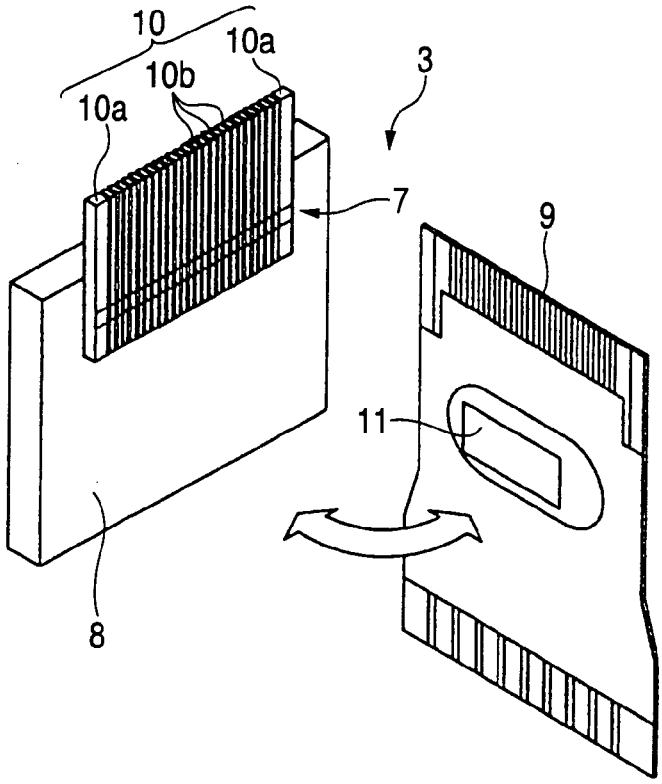
FIGS. 3A and 3B are views for explaining a vibrator unit.
Figure 3B:
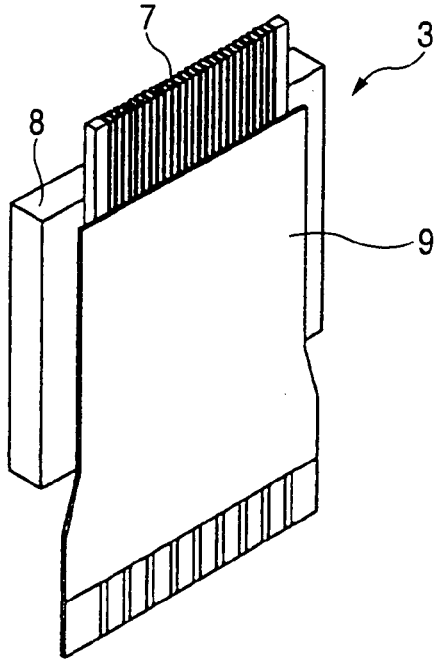

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
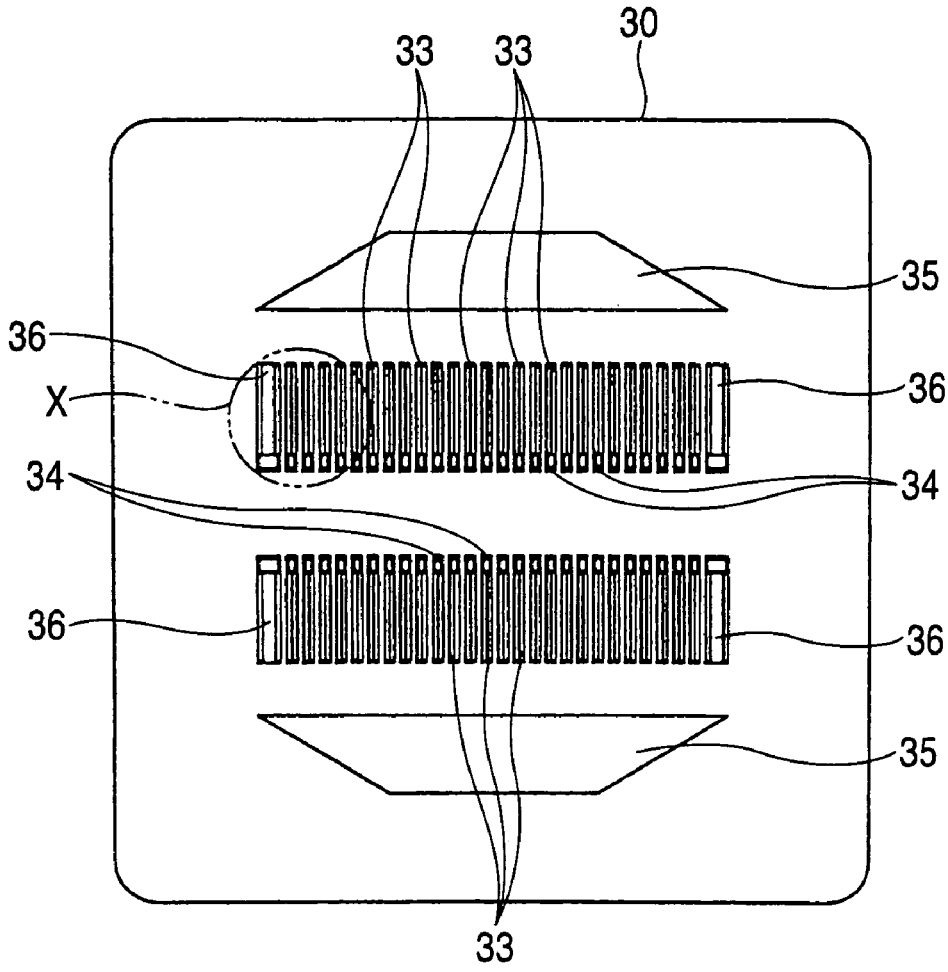
FIG. 4 is a plan view of a chamber formation plate.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
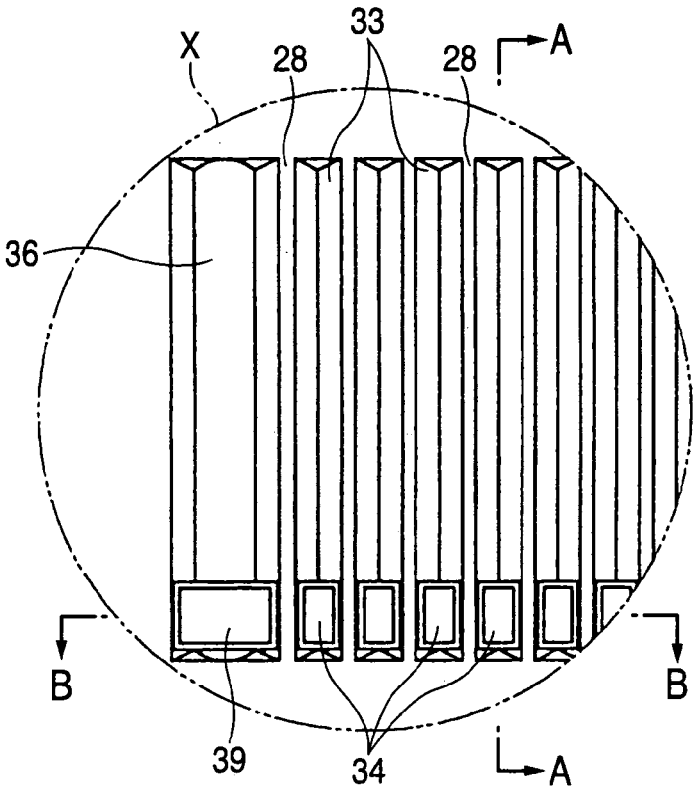
FIG. 5A is a view enlarging an X portion in FIG. 4.
Figure 5B:
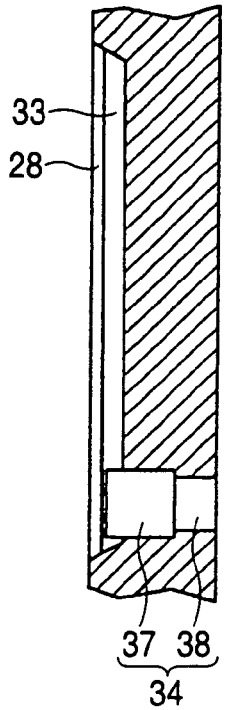
FIG. 5B is a sectional view taken along a line A-A of FIG. 5A.
Figure 5C:
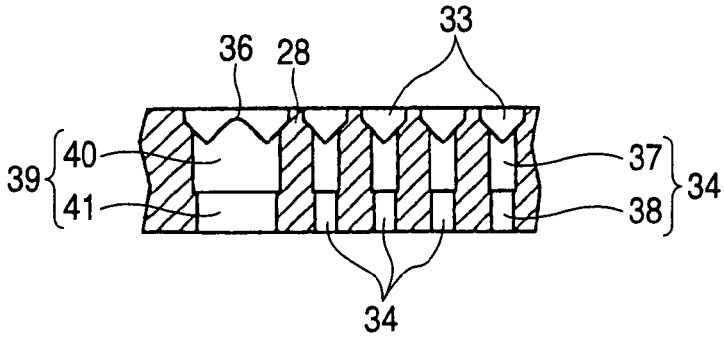
FIG. 5C is a sectional view taken along a line B-B of FIG. 5A.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
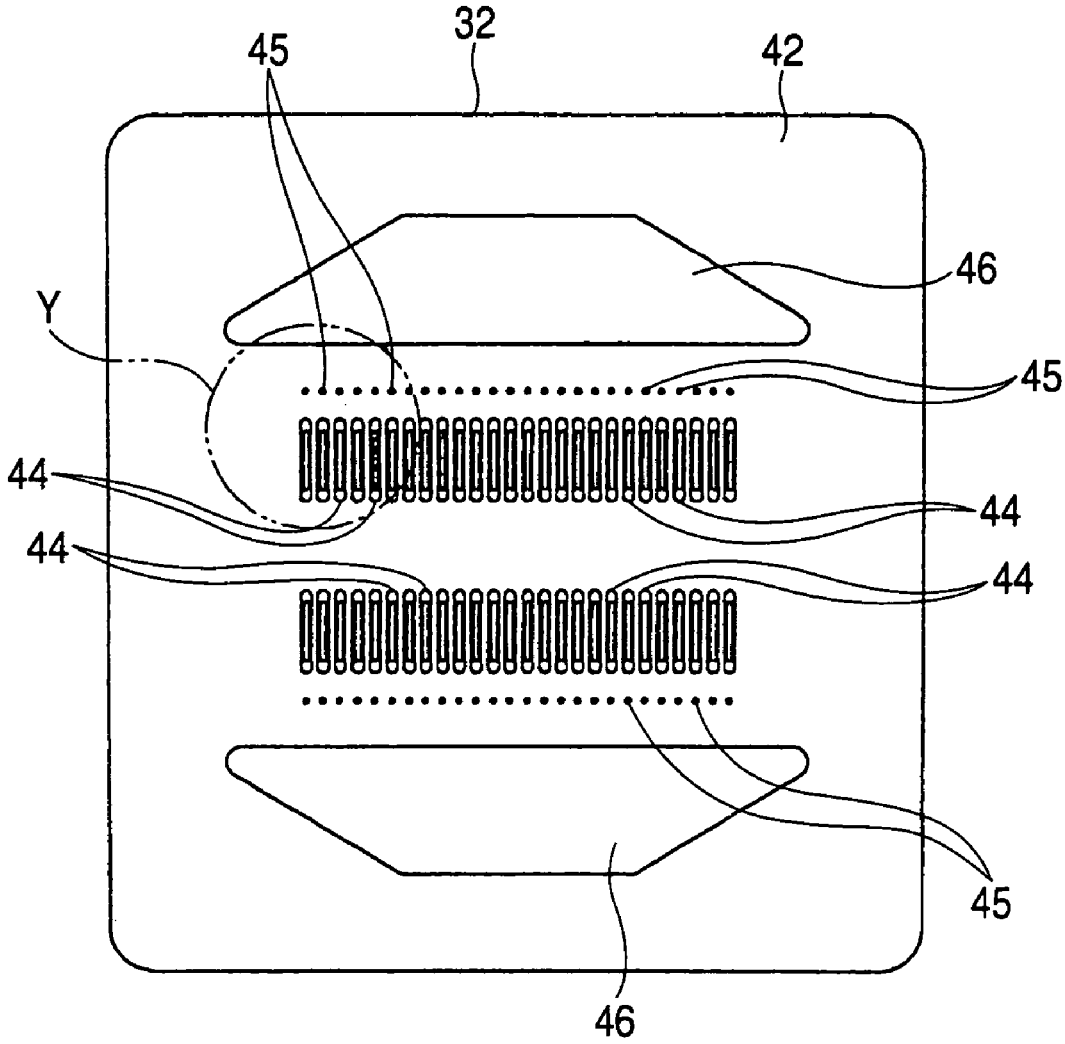
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
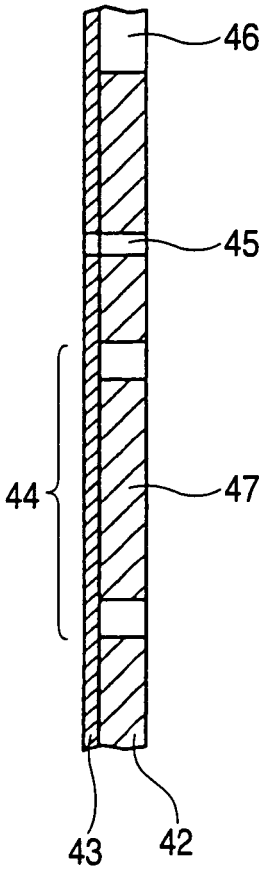
FIG. 7B is a sectional view taken along a line C-C of FIG. 7A.
Figure 7A:
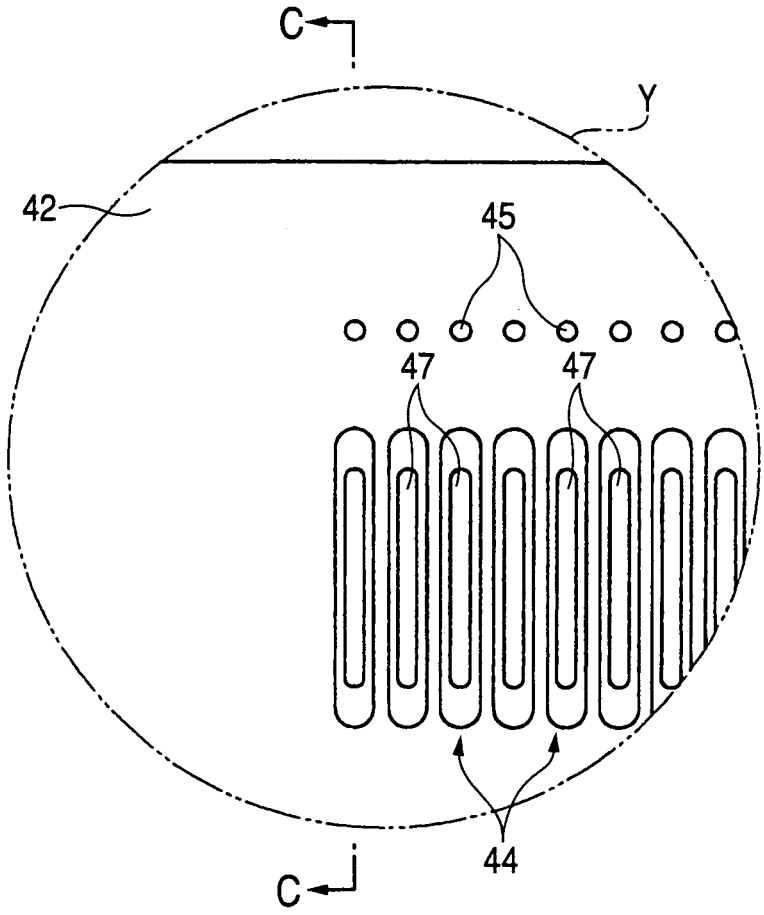
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

In a case where the compliance portion 46 is omitted while reducing the volume of the common ink reservoir 14, the escaping recess portion 35 may serve as a part of the common ink reservoir. Further, the escaping recess portion 35 may be formed as a through hole so that the obtained space is used as a part of the common ink reservoir.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal strip 55 (referred to as "strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
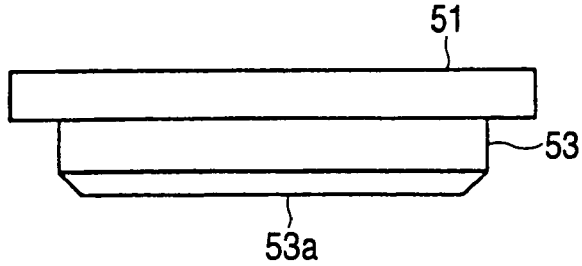
FIGS. 8A and 8B are views for explaining a first male die used in forming elongated recess portions.
Figure 8B:
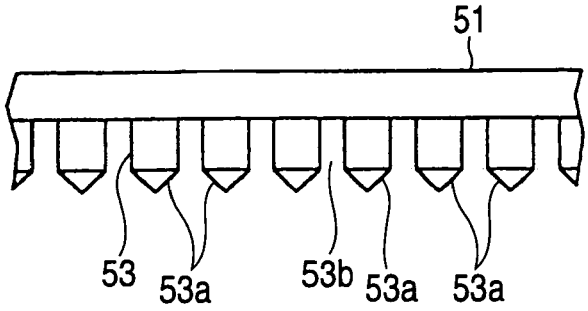
Figure 9A:
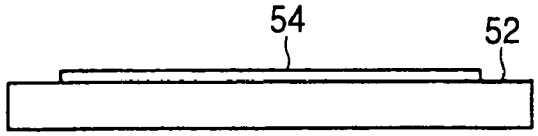
FIGS. 9A and 9B are views for explaining a female die used in forming the elongated recess portions.
Figure 9B:
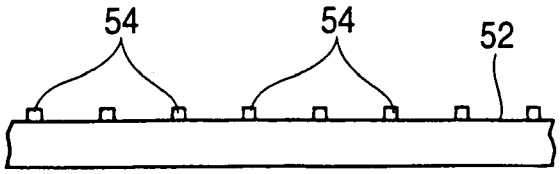

In the elongated recess portion forming steps, a first male die 51 shown in FIGS. 8A and 8B and a female die shown in FIGS. 9A and 9B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
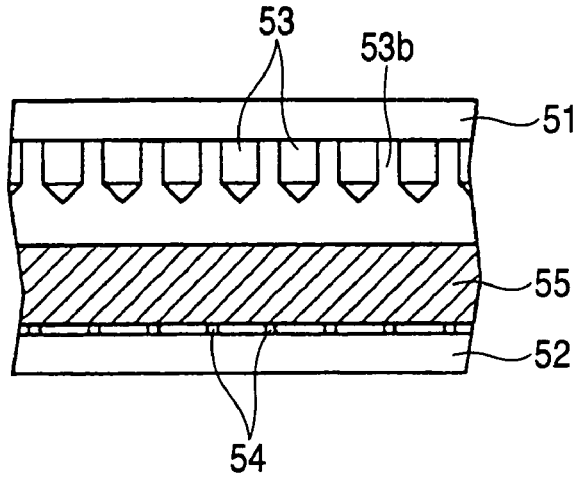
FIGS. 10A to 10C are views for explaining a step of forming the elongated recess portions.
Figure 10B:
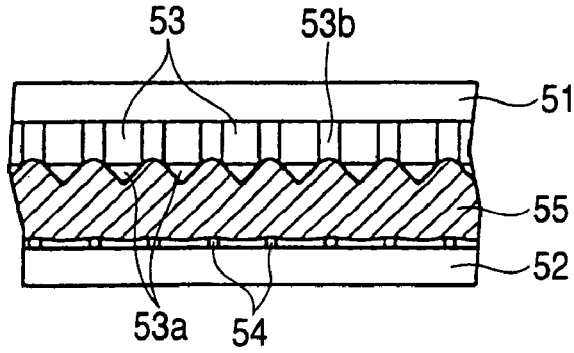
Figure 10C:
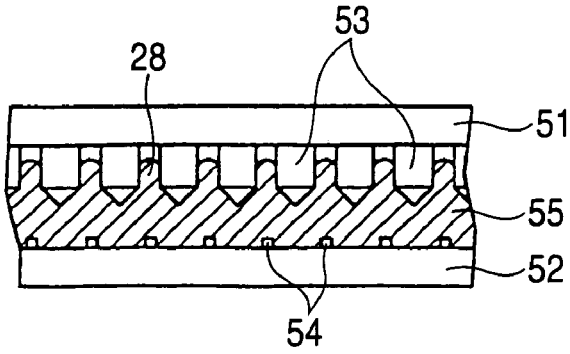

In the elongated recess portion forming steps, first, as shown in FIG. 10A, the strip 55 is mounted at an upper face of the female die 52 and the first male die 51 is arranged on an upper side of the strip 55. Next, as shown in FIG. 10B, the first male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a middle in a plate thickness direction of the strip 55 as shown in FIG. 10C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

When the elongated recess portions 33 have been formed in this way, the operation proceeds to the stage to form the communicating port 34 which is the minute hole.

Figure 11A:
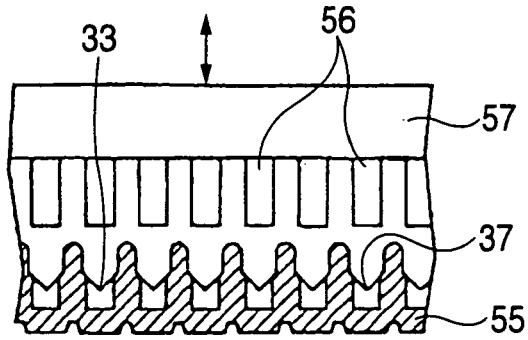
FIG. 11A is a view for explaining a second male die used in forming first communicating ports.
Figure 11B:
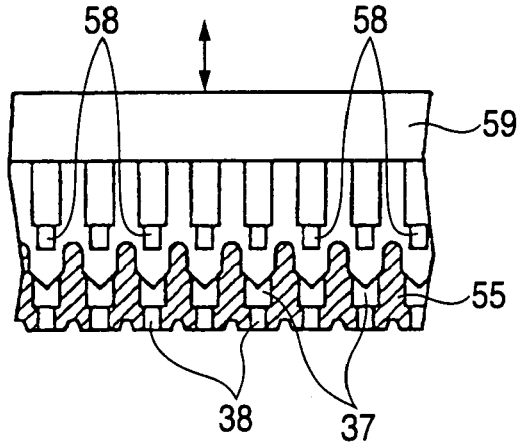
FIG. 11B is a view for explaining a third male die used in forming second communicating ports.

As shown in FIGS. 11A and 11B, in this stage, a second male die 57 and a third male die 59 are used. In the second male die 57, a plurality of pectinated first punches 56 in a shape of a prism in correspondence with the shape of the first communicating port 37 are aligned on a base member at a predetermined pitch. In the third male die 59, a plurality of pectinated second punches 58 in a shape of a prism in correspondence with the shape of the second communicating port 38 are aligned on a base member at a predetermined pitch. Further, the second punches 58 are somewhat thinner than the first punches 56.

In this stage, the communicating ports 34 which are minute holes aligned in a row are simultaneously punched by unanimously moving up and down the aligned first punches 56 and the aligned second punches 58.

First, as shown in FIG. 11A, the first punches 56 of the second male die 57 are pushed up to a middle in a plate thickness direction from a surface of the strip 55 from a side of the elongated recess portions 33 to thereby form unpenetrated recess portions to be the first communicating ports 37. Next, as shown in FIG. 11B, the second punches 58 of the third male die 59 is pushed from the same side to punch through bottom portions of the first communicating ports 37 to thereby form the second communicating ports 38 which are through holes.

Figure 12:
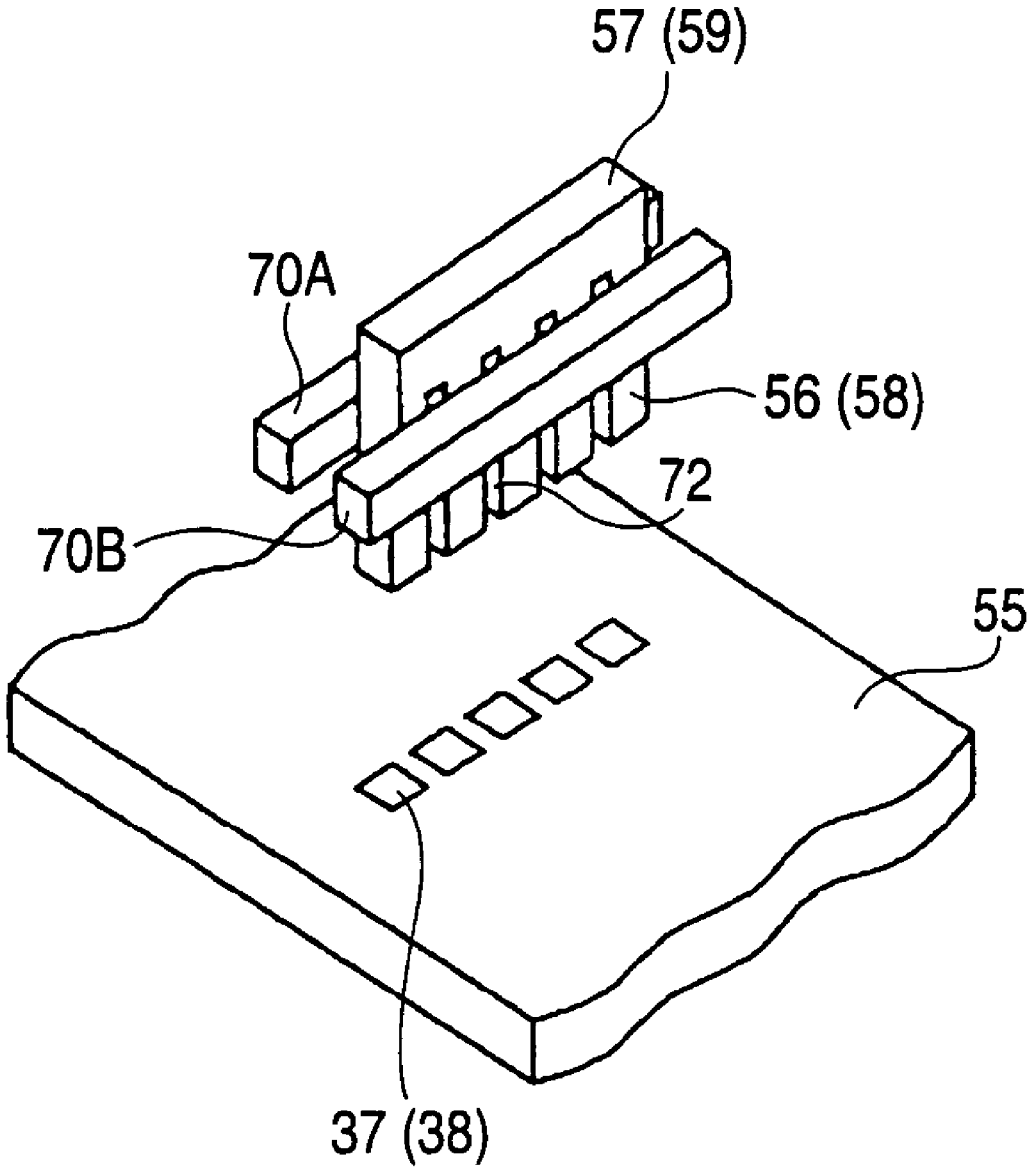
FIG. 12 is a perspective view showing a state that punches are held between guide members.

Incidentally, as shown in FIG. 12, the above working is carried out while the first punches 56 and the second punches 58 are respectively guided by guide members 70A and 70B. A detailed explanation will be given of the point as follows.

Figure 13A:
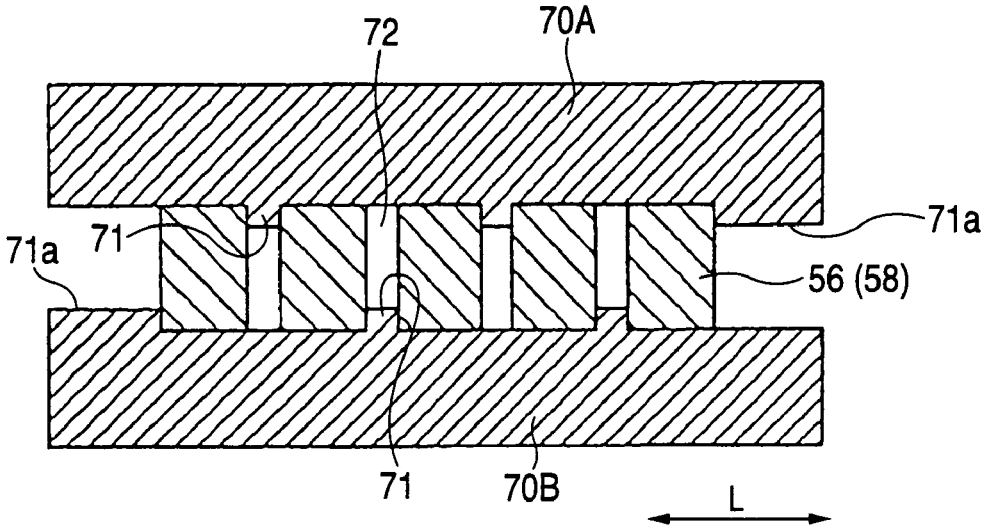
FIG. 13A is a horizontal section view of the state shown in FIG. 12.
Figure 13B:
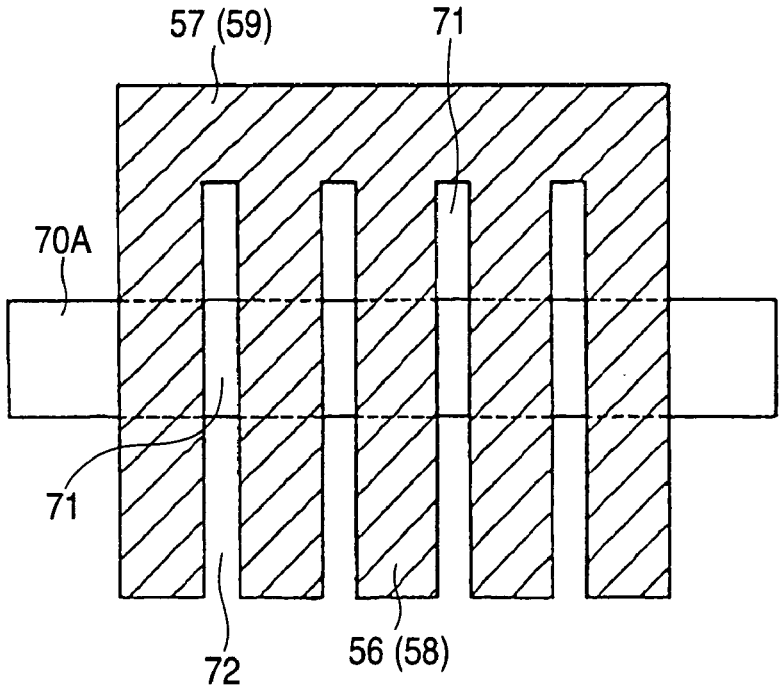
FIG. 13B is a vertical section view of the state shown in FIG. 12.

FIGS. 13A and 13B schematically shows the guide members 70A and 70B for guiding the respective punches 56, 58. Although only five sets of the punches 56, 58 are shown in the drawings, actually, the punches 56, 58 are aligned by a number as same as that of the elongated recess portions 33 for constituting the pressure generating chambers 29.

Figure 14:
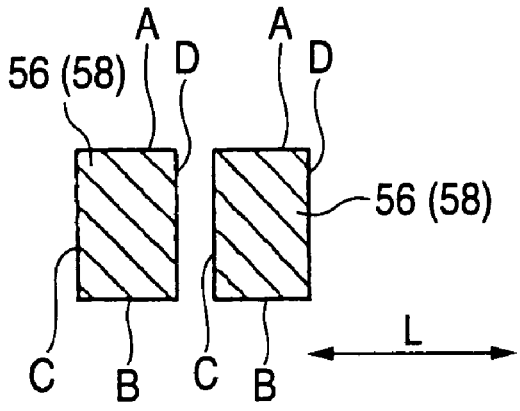
FIG. 14 is a horizontal section view of the punches.

As shown in FIG. 14, respective sectional shapes of the first and the second punches 56, 58 are rectangular and faces A and B including two parallel sides of the rectangular shape are aligned respectively along the aligning direction L at the predetermined pitch. Further, the two side faces A and B along the aligning direction of the respective aligned punches 56, 58 are guided by the guide members 70A and 70B from two directions.

The guide members 70A and 70B are in a shape of a pair of square rods extended in the aligning direction L of the punches 56, 58 and the two side faces A and B along the aligning direction of the respective punches 56, 58 are guided by inner side faces of the guide members 70A and 70B opposed to each other.

The respective guide members 70A and 70B are provided with projections 71 for guiding faces C and D of the punches 56, 58 facing a clearance 72 between the aligned punches 56, 58 (see FIG. 14). The projections 71 are formed to extend in the vertical direction over from upper ends to lower ends of the guide members 70A and 70B at inner side faces thereof. As shown in FIG. 13A, the projections 71*a*, for guiding outer side faces in the aligning direction L of the punches 56, 58 disposed at both end portions of the aligned punches 56, 58, are formed as a stepped shape.

Grinding the inner side faces of the guide members 70A and 70B so as to form grooves, the projections 71 and 71*a* are defined by the grooves. Since such a grinding work is relatively inexpensive means, the manufacturing cost can be reduced. Further, such a grinding work can provide the projections 71 and 71*a* with high accuracy, the guiding preciseness of the guide members 70A and 70B can be secured. The processing accuracy of the communicating port 34 can be accordingly secured.

As shown in FIG. 13A, the projections 71 are provided at every other clearance 72 between the aligned punches 56, 58 in the guide member 70A on one side and provided at every other clearance 72 also in the guide member 70B on other side. Therefore, two punches 56, 58 are placed between a pair of projections 71 in either guide member 70A or 70B. Further, the projections 71 are alternately arranged such that each punch 56, 58 is guided by a pair of projections 71 respectively provided on the guide members 70A and 70B.

By arranging the projections 71 in this way, four-directional guidance can be attained, so that bending or escaping of the punches 56, 58 in the midst of working can significantly be restrained. Accordingly, the shape accuracy, the dimensional accuracy and the alignment accuracy of each communicating port 34 can remarkably be promoted.

Further, since the projections 71 are provided at every other clearances 72 between the punches 56 and 57, numbers of the projections 71 formed at each of the guide members 70A and 70B can be reduced. Accordingly, the grinding work of the guide members 70A and 70B for forming the projections 71 can be simplified, so that the working cost can further be reduced.

In a state that the four side faces of each of the punches 56, 58 are guided by the inner side faces of the guide members 70A and 70B and projections 71 and 71*a*, the punches 56, 58 are pressed into the strip 55 to form the communicating ports 34 aligned in a row.

Since working can be carried out in a state of preventing bending or escaping of the punches 56, 58, wear or damage of the punches 56, 58 can significantly be reduced, so that tool life can significantly be prolonged. Accordingly, the accuracy of the communicating port 34 can be maintained over a long time period, which is advantageous in view of the quality control of the process.

Further, in this stage, the small communicating port 34 is formed by punching through the V-shaped bottom portion of the elongated recess portion 33 which has been plastically worked by pressing. Since such a portion has relatively higher hardness and workability is deteriorated, it is difficult to attain the working accuracy at the time of forming the small communicating port 34. However, according to the above configuration, since the bending or escaping of the punches are prevented by the guide members 70A and 70B, the working can be carried out with high accuracy while prolonging the lifetime of the dies.

Figure 15:
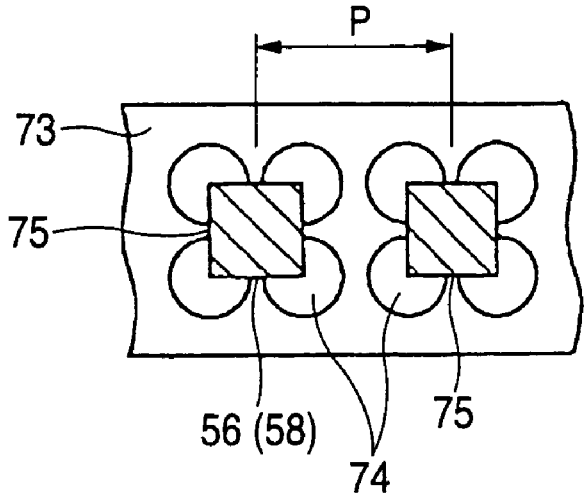
FIG. 15 is a view showing a conventional structure for guiding the punches.

FIG. 15 shows a well-known configuration for holding the punches in which the punch 56, 58 having a rectangular cross section is guided by guide portions 75 defined by quasi-circular holes 74. In such a case, since a guidance area of the guide portions 75 with respect to the punch is extremely small, wear or damage of the guide portion 75 is remarkable and the lifetime of the guide member 73 becomes short. On the other hand, according to the above guidance configuration, the guidance area can be widely secured, so that the lifetime of the guide members 70A and 70B can significantly be prolonged.

Further, in the case of FIG. 15, a certain pitch dimension P is needed so that it is difficult to simultaneously form minute holes aligned with a relatively small pitch. However, according to the invention, even in a case where the pitch P becomes small, since the punches 56, 58 can stably be guided, high working accuracy can be ensured.

The invention is effective when the pitch P is set to be 0.3 mm or less to form the communicating ports 34 aligned with the pitch. The invention is more effective when the pitch dimension P is 0.25 mm or less, and further effective when the pitch dimension is 0.2 mm or less.

Further, the invention is particularly effective when forming the communicating port 34 having the size of the opening of 0.2 mm or less, or when forming the minute hole in which a ratio of a thickness, that is, the penetrated dimension of the strip 55 with respect to the opening dimension of the communicating port 34 is 0.5 or more. Further, the invention is more effective in forming the minute hole having the ratio is 0.8 or more, and further effective when forming the minute hole having the ratio is 1 or more. In the embodiment, the opening dimension of the communicating port 34 is a rectangular shape of 0.095 mm×0.16 mm.

In the embodiment, since the communicating port 34 is fabricated by working at a plurality of times by using the punches 56, 58 having different thicknesses, even the extremely small communicating port 34 can be fabricated with excellent dimensional accuracy. Further, since the first communicating port 37 fabricated from the side of the elongated recess portion 33 is formed only up to the middle in the plate thickness direction, it is prevented a drawback that the partition wall portion 28 or the like of the pressure generating chamber 29 is excessively pulled downward. Thereby, the communicating port 34 can be fabricated with excellent dimensional accuracy without deteriorating the shapes of the V-shaped bottom portion of the elongated recess portion 33 and the partition wall portion 28.

Although steps of fabricating the communicating ports 34 by two times of working are exemplified, the communicating ports 34 may be fabricated by working of three times or more. Further, when the above-described drawback is not brought about, the communicating port 34 may be fabricated by a single working.

Figure 11C:
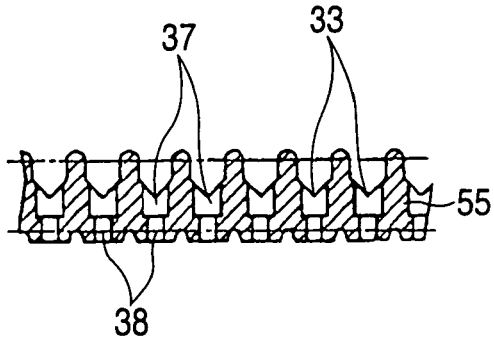
FIG. 11C is a view for explaining a polishing step.

After the communicating ports 34 are fabricated, both surfaces of the strip 55 are polished to flatten along the chain lines shown in FIG. 11C, so that the plate thickness is adjusted to a predetermined thickness (0.3 mm, in the embodiment).

The step of forming the elongated recess portions and the step of forming the communicating ports may be carried out by separate stages or carried out by the same stage. In a case where the steps are carried out by the same stage, since the strip 55 remains unmoved at both stages, the communicating port 34 can be fabricated in the elongated recess portion 33 with excellent positional accuracy.

After the chamber formation plate 30 is fabricated by the above-described steps, the flow path unit 4 is fabricated by bonding the elastic plate 32 and the nozzle plate 71 which are fabricated separately. In the embodiment, bonding of the respective members is carried out by adhering. Since the both surfaces of the chamber formation plate 30 are flattened by the above-described polishing, the elastic plate 32 and the nozzle plate 31 can firmly be adhered thereto.

Since the elastic plate 32 is the composite material constituting the support plate 42 by the stainless steel plate, the linear expansion rate is prescribed by stainless steel constituting the support plate 42. The nozzle plate 31 is also fabricated by the stainless steel plate. As described above, the linear expansion rate of nickel constituting the chamber formation plate 30 is substantially equal to that of stainless steel. Therefore, even when adhering temperature is elevated, warping caused by the difference between the linear expansion rates is not brought about. As a result, the adhering temperature can be set higher than a case where a silicon substrate is used, so that adhering time can be shortened and fabrication efficiency is promoted.

After the flow path unit 4 is fabricated, the vibrator unit 3 and the flow path unit 4 are bonded to the case 2 fabricated separately. Also in this case, bonding of the respective members is carried out by adhering. Therefore, even when the adhering temperature is elevated, warping is not brought about in the flow path unit 4, so that adhering time is shortened.

After the vibrator unit 3 and the flow path unit 4 are bonded to the case 2, the flexible cable 9 of the vibrator unit 3 and the connection board 5 are soldered, thereafter, the supply needle unit 6 is attached thereto to thereby provide the liquid ejection head.

Figure 16:
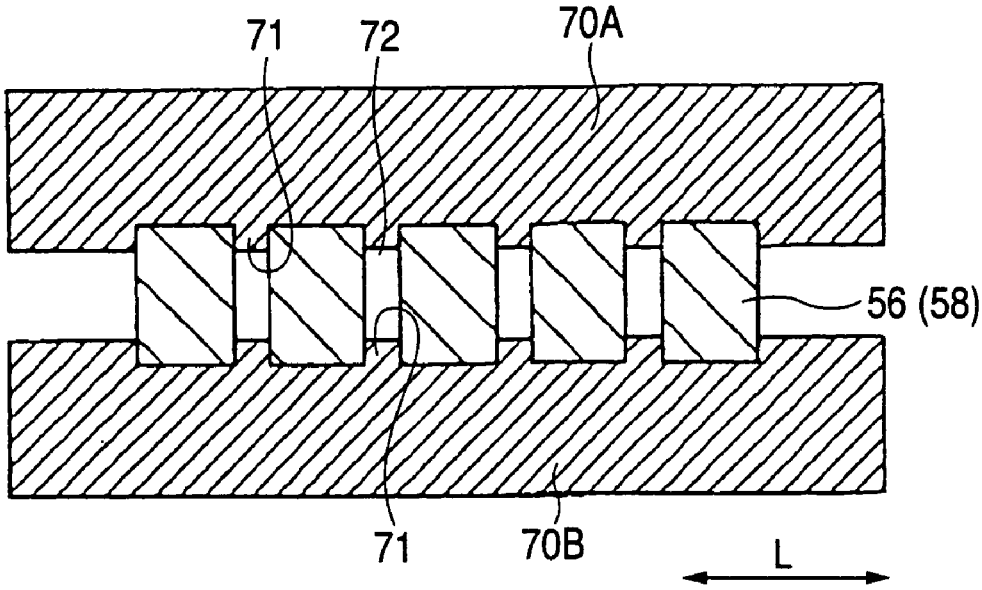
FIG. 16 is a horizontal section view showing a first modified example of the guide members.

FIG. 16 shows a first modified example of the guide members. In this case, the projections 71 at the inner side faces of the guide members 70A and 70B are provided at all of the clearances 72. By constituting in this way, the four side faces of the respective punches 56, 58 can firmly be guided and working with higher accuracy can be carried out.

Figure 17:
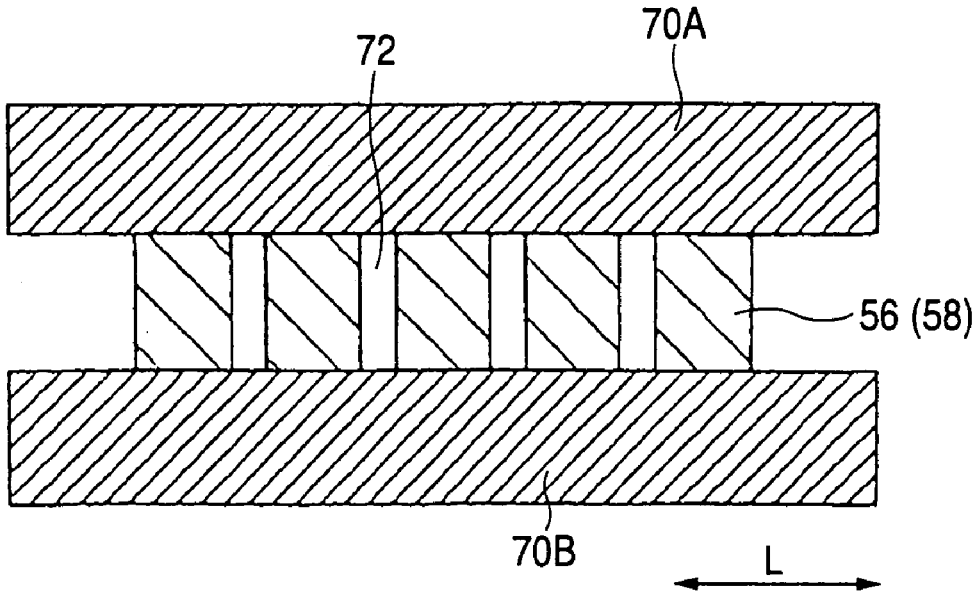
FIG. 17 is a horizontal section view showing a second modified example of the guide members.

FIG. 17 shows a second modified example of the guide members. In this case, the projections 71 are not formed at the inner side faces of the guide members 70A and 70B and only the two faces A and B of the respective punches 56, 58 are guided. With such a configuration, cost can be saved by simplifying the shapes of the guide members 70A and 70B while ensuring the guiding effect.

Next, an explanation will be given of an apparatus of fabricating a liquid ejection head using the method of punching the communicating port.

Figure 19:
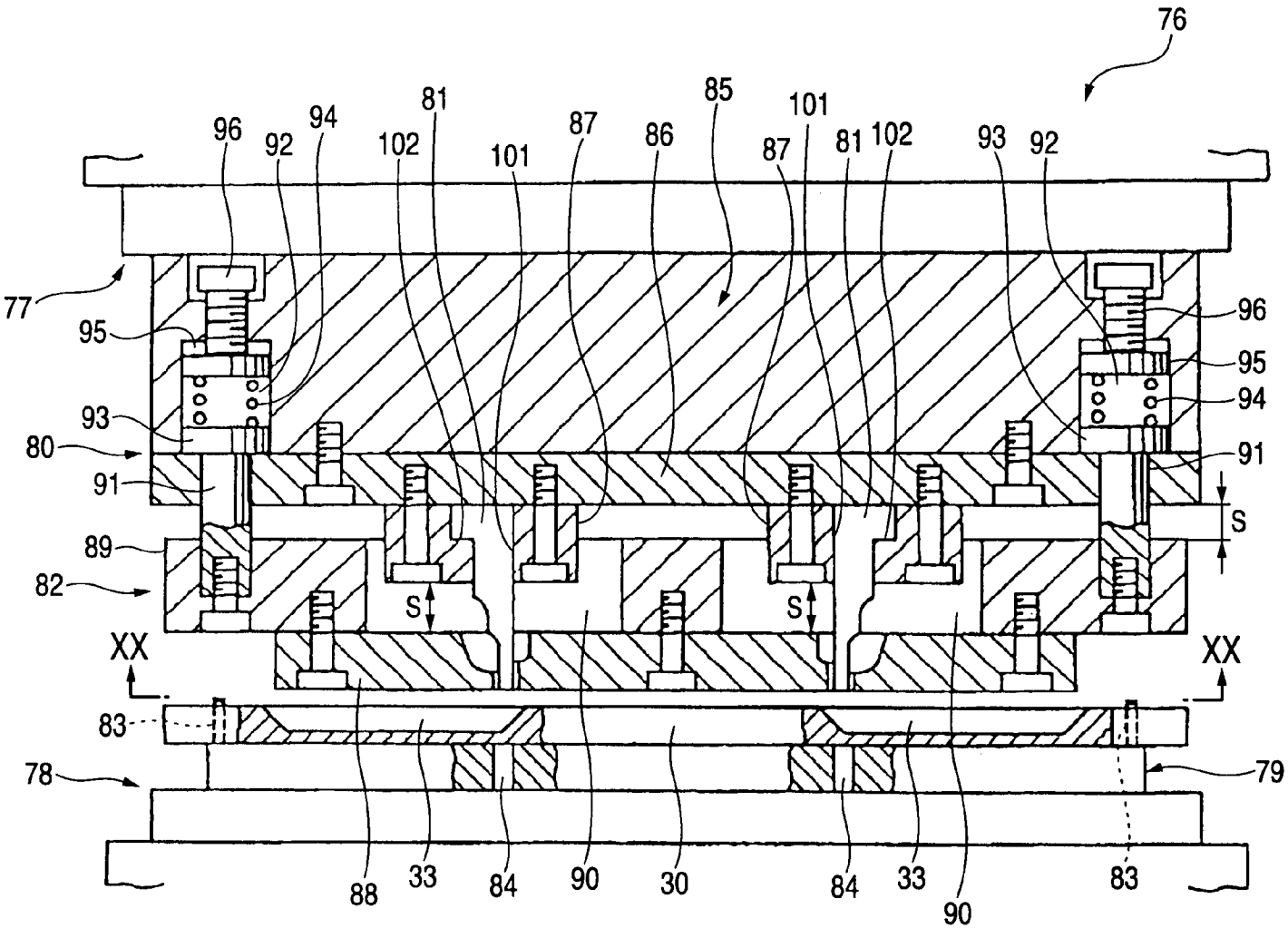
FIG. 19 is a partially sectional view showing an apparatus for manufacturing a liquid ejection head.

As shown in FIG. 19, the fabricating apparatus 76 is roughly constituted by: an upper operation unit 77; a lower operation unit 78; a first die 79 fixed to the lower operating portion 78; a second die 80 fixed to the upper operation unit 77; a male die 81 fixed to the second die 80; and a guide member 82 attached to the second die 80 for guiding the male die 81.

In the apparatus, the upper operation unit 77 is operated to move vertically by a driving device (not illustrated).

In the first die 79, the chamber formation plate 30 corresponding to the above described strip 55 is placed at a predetermined position defined by reference pins 83. The first die 79 is formed with openings 84 for each receiving the male die 81. The chamber formation plate 30 is previously formed with the elongated recess portions 33 by the steps shown in FIGS. 10A to 10C.

The second die 80 is constituted by a base member 85 coupled to the upper operation unit 77 and a punch plate 86 coupled to the base member 85. The punch plate 86 is attached with the male die 81 via a fixing piece 87. Two male dies 81 are provided in association with two rows of elongated recess portions 33 to form the communicating ports 34 therein.

The guide member 82 is integrally formed with a guide plate 88 and a guide base member 89, and is provided with a space 90 for avoiding interference with the fixing piece 87 and allowing relative displacement, mentioned later. The guide member 82 corresponds to the above-described guide member 70A or 70B and is constructed by a structure of integrating the guide plate 88 and the guide base member 89 by illustrated bolts, however, these members may be constituted by a single member, or may be constituted by three or more members.

The guide member 82 is attached to the second die 80 while being able to move relative to the actuating direction of the male die 81. Actuating shafts 91 are fixed to the guide base member 89 while being extended in parallel with the actuating direction of the upper operation unit 77. An upper end portion of each actuating shaft 91 is extended into a chamber 92 formed in the base member 85. The chamber 92 is a cylinder-shaped space having a circular cross section whose inner diameter is larger than a diameter of the actuating shaft 91 also having a circular cross section. A stopper 93 is fixed to an upper end of the actuating shaft 91, so that the stopper 93 is capable of moving vertically in the chamber 92 like a piston. A compression coil spring 94 is inserted into the chamber 92 to urge the stopper 93 in a direction that the guide member 82 is separated from the second die 80. A bolt 96 is provided to adjust a position of a spring seat 95 to thereby adjust the urging force of the coil spring 94 acting on the stopper 93. The compression coil spring 94 may be replaced with a rubber piece.

In order to move the guide member 82 relative to the second die 80, a displacement space S is provided between the second die 80 and the guide member 82. Also in the space 90, a similar displacement space is provided between a lower face of the fixing piece 87 and an upper face of the guide plate 88.

Figure 22:
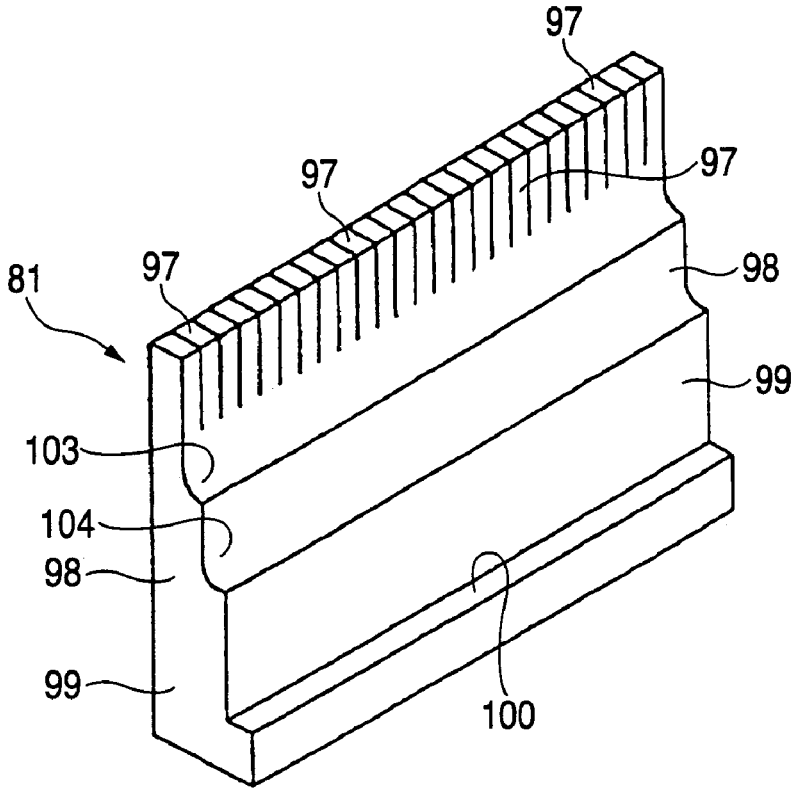
FIG. 22 is a perspective view of a male die incorporated in the manufacturing apparatus.
Figure 23:
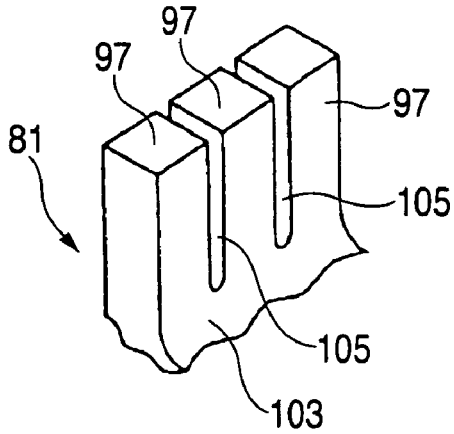
FIG. 23 is an enlarged perspective view showing a distal end portion of the male die.

FIG. 22 and FIG. 23 are perspective views respectively showing an entire shape and a punch portion of the male die 81. The male die 81 corresponds to the above-described second male die 57 or the third male die 59, and a number of punches 97 are arranged in a row at a distal end portion thereof. The punches 97 are continued from a high rigidity portion 98 such that a sectional area of the high rigidity portion is larger than a total sectional area of the punches 97. Further, the high rigidity portion 98 is continued from a base portion 99 having a higher sectional area than that of the high rigidity portion 98.

Further, the base portion 99 is formed with a flange 100 in a direction substantially orthogonal to the actuating direction of the male die 81. The fixing piece 87 is provided with an elongated hole 101 into which the base portion 99 is inserted and a retaining face 102 which abuts against the flange 100. The punches 97 and the high rigidity portion 98 or the high rigidity portion 98 and the base portion 99 are smoothly connected by curved faces 103 and 104.

As shown by FIG. 23, a slit 105 is provided between the contiguous punches 97 and a pitch of the respective punches 97 are as same as a pitch of the elongated recess portions 33.

Figure 20:
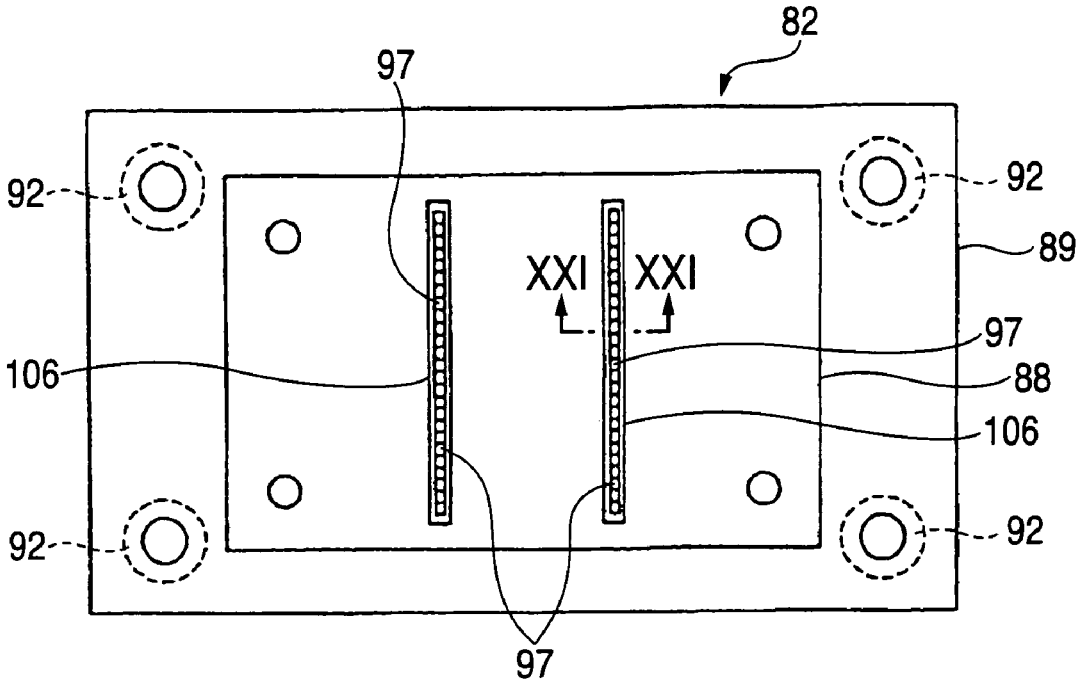
FIG. 20 is a plan view taken along a line XX-XX in FIG. 19.
Figure 21:
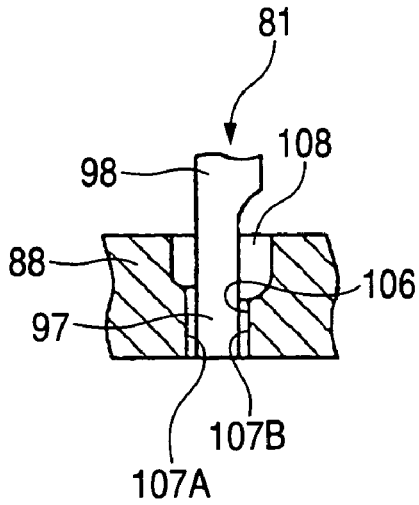
FIG. 21 is a section view taken along a line XXI-XXI in FIG. 20.

The male die 81 is placed at a such a position that each of the punches 97 arrayed in a direction perpendicular to the longitudinal direction of each elongated recess portion 33 opposes to one longitudinal end portion of each elongated recess portion 33. In the embodiment, the guide member 82 guides a portion of the male die 81 where the punches 97 are provided, and the guide member 82 is formed with a slit hole 106 through which the punches 97 are allowed to penetrate, as shown in FIG. 20. Inner faces of the slit hole 106 opposed to each other serve as control faces 107A and 107B for restraining the punches 97 from displacing in the longitudinal direction of the elongated recess portion 33. The control faces 107A and 107B are brought into a sliding contact with both side portions of the punches 97. Alternatively, small clearances may be provided between the control faces 107A and 107B and the both side portions of the punches 97. In FIGS. 19 and 21, although the clearance is illustrated to be considerably large, the actual clearance is provided such an extent that the above-described sliding contact may be established. The guide plate 88 is formed with a slender recess groove 108 continued from the slit hole 106, for receiving the high rigidity portion 98, as shown in FIG. 21.

FIG. 19 shows a state before the forging work for forming the communicating ports 34 is started. In this state, the stopper 93 is brought into close contact with the lower face of the chamber 92 by the spring force of the compression coil spring 94 to define a relative position between the guide plate 88 and the punches 97. Further, in this state, the lower face of the guide plate 88 and the distal end faces of the punches 97 are made flush with each other.

Figure 24:
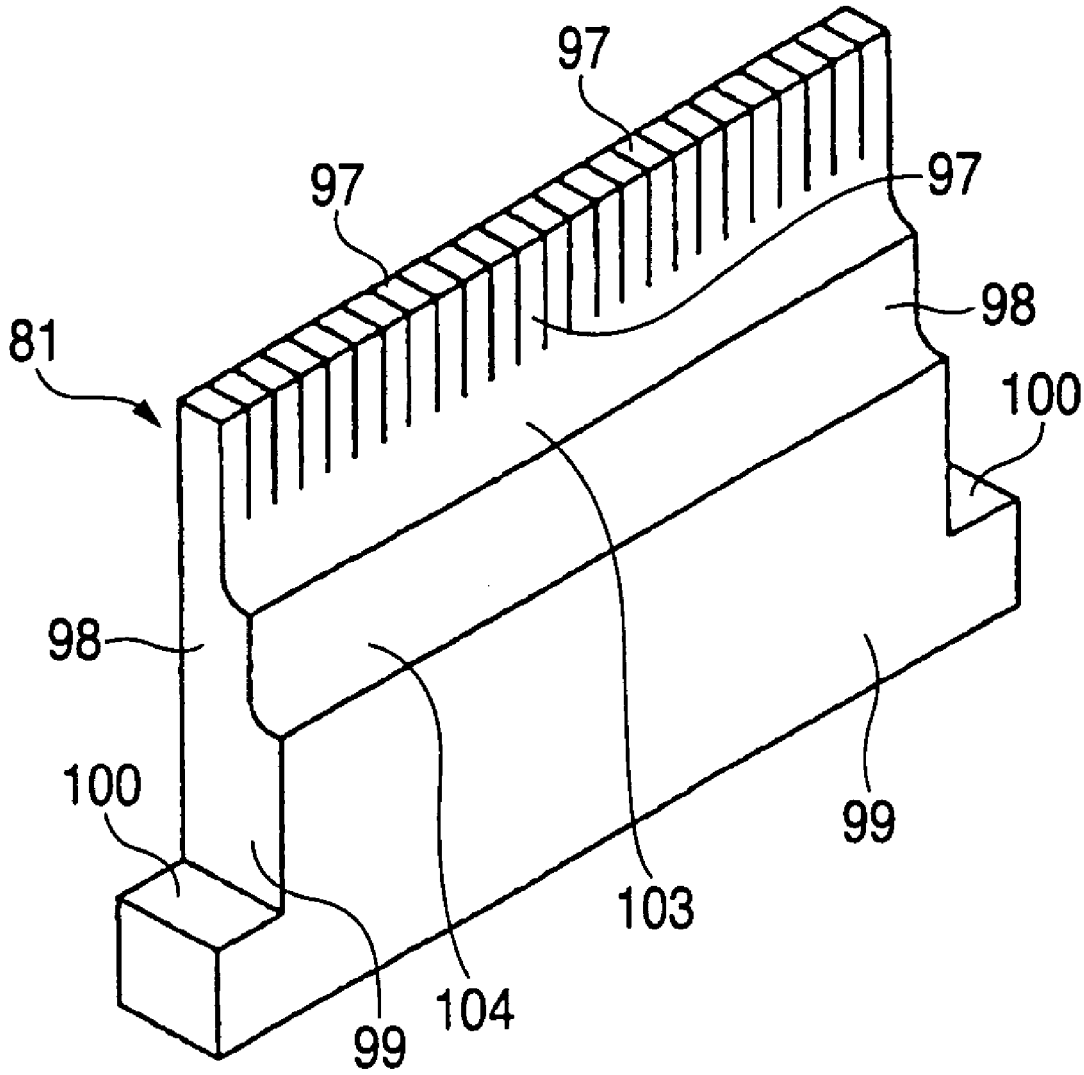
FIG. 24 is a perspective view showing a modified example of the male die.

FIG. 24 shows a modified example of the male die 81 in which the flange 100 is formed on both side end faces of the male die 81.

Operation of the apparatus 76 of fabricating the recording head will be explained.

When the second die 80 is lowered from the state shown in FIG. 19, the guide plate 88 and the punches 97 are also lowered while maintaining their relative position relationship. Then the guide plate 88 is first brought into close contact with the chamber formation plate 30 so that the guide member 82 is stopped. Thereafter, when the second die 80 is lowered further, the punches 97 are projected from the guide plate 88 while the compression coil spring 94 are cut into the end portions of the elongated recess portions 33. When a press length of the punches 97 reaches a predetermined level, the second die 80 is lifted up so that the punches 97 are drawn from the chamber formation plate 30 while the guide plate 88 is pressing the chamber formation plate 30 by the compression coil spring 94.

Owing to the structure that the press work is carried out while guiding the both side portions of the punches 97 by the control faces 107A and 107B in the slit hole 106 formed at the guide plate 88, bending or escape of the punches 97 by stresses produced by working is prevented. Accordingly, the shape, dimensional and alignment accuracy of each communicating port 34 are enhanced. Further, wear or damage of the punches 97 can considerably be reduced and tool life can considerably be prolonged, the accuracy of the communicating port 34 can be maintained over a long time period. Further, the communicating port 34 can be worked with excellent dimensional accuracy without deteriorating contiguous ones of the communicating ports 34 even in a case where the communicating ports 34 which are aligned at a relatively small pitch.

Since the elongated recess portion 33, which has been subjected to the plastic working in advance, has relatively higher hardness and workability is deteriorated, it is difficult to attain the working accuracy at the time of forming the small communicating port 34. However, according to the above configuration, since the bending or escaping of the punches 97 are prevented by the guide member 82, the working can be carried out with high accuracy while prolonging the lifetime of the dies.

Even in a case where the press length of the punches 97 to the chamber formation plate 30 is prolonged, since the guide plate 88 is brought into close contact with the surface of the chamber formation plate 30 or disposed at the extreme vicinity of the chamber formation plate 30, the guiding function of the guide plate 88 is achieved at the location as proximate as possible to the portion of generating stresses produced by working, so that the bending or escape of the punches 97 by working stresses can further securely be prevented.

Although the punches 97 are more liable to be bent or escaped in the longitudinal direction substantially orthogonal to the aligning direction than in the aligning direction, by restraining the displacement of the punches 97 by the control faces 107A and 107B, bending or escape of the punches 97 are prevented so that the communicating ports 34 are formed with high accuracy.

Since the control faces 107A and 107B are defined by the inner faces of the slit hole 106 formed in the guide plate 88, such inner faces has high rigidity capable of withstanding large load. Therefore, the control faces 107A and 107B can be made to carry out stable guiding function. Further, since the control faces 107A and 107B can be ensured immediately by forming the slit hole 106, the control faces 107A and 107B can be provided by simple constitution.

The relative positions of the guide plate 88 and the punches 97 before starting the punching work are accurately set by the actuating shaft 91, the stopper 93, the compression coil spring 94 and the like. That is, it is surely possible to determine the proper relative positions of the punches 97 and the guide plate 88 in which the punches 97 abnormally projected from the guide plate 88. Further, when the punches 97 are pressed, since the guide plate 88 is pressed onto the chamber formation plate 30 by the compression coil spring 94, the guiding function of the guide plate 88 is achieved at the location most proximate to the punching portion, so that bending or escape of the punches 97 can be prevented at the optimum location.

The sectional areas of the punches 97, the high rigidity portion 98 and the base portion 99 are successively increased and the rigidity of the total of the male die 81 is set to be the largest at the base portion 99. Therefore, since the rigidity of the male die 81 is increased gradually toward the fixed side, stresses are not abnormally concentrated on a particular location of the male die 81 when the punches 97 are actuated. Accordingly, the durability of the total structure of the male die 81 can be enhanced. Further, the rigidity of attaching the male die 81 to the second die 80 can be ensured in the stable state, so that durability sufficient for frequent punching operation can be attained.

Since the male die 81 is attached to the fixing piece 87 while the flange 100 is firmly retained, the rigidity of attaching the male die 81 to the second die 80 can be increased. Particularly, when the punches 97 pressed into the chamber formation plate 30 is withdrawn, it is necessary to transmit the large withdrawing force from the second die 80 to the male die 81. In such an occasion, since the flange 100 is pressed by the retaining face 102 of the fixing piece 87, the male die 81 and the second die 80 can be withdrawn with firm integrity, so that the fabricating apparatus 76 having excellent operational stability is provided.

By a plurality of the male dies 81, the communicating ports 34 can be formed by one operation at the respective elongated recess portions 33 so that the productivity can be promoted. Further, even when two of the male dies are arranged to be able to form two rows of the communicating ports in parallel, promotion of productivity is also achieved.

Further, the guide plate 88 is provided with a simple structure while realizing multi-function. That is, the slit hole 106 achieving guiding function and a bottom face for pressing the chamber formation plate 30.

Figure 25A:
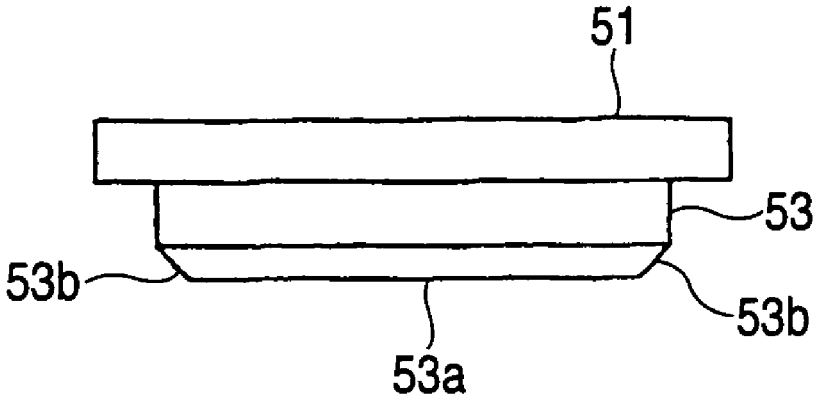
FIG. 25A is a side view showing a modified example of the first male die.
Figure 25B:
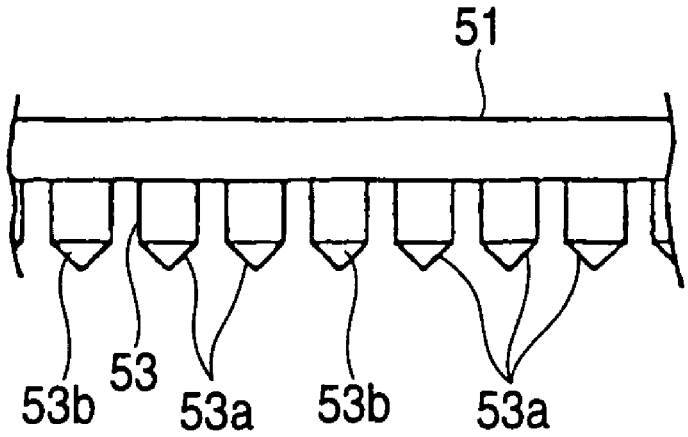
FIG. 25B is a front view of the modified example of the first male die.
Figure 26A:
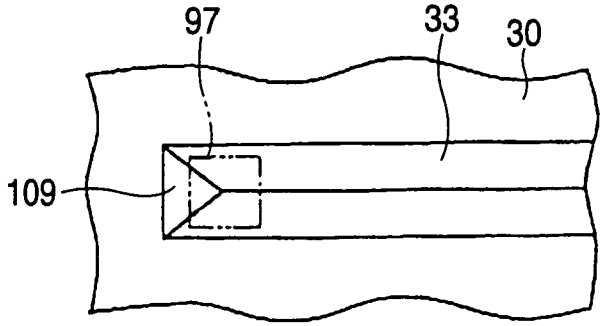
FIG. 26A is a plan view for explaining a first modified example of the manufacturing apparatus.
Figure 26B:
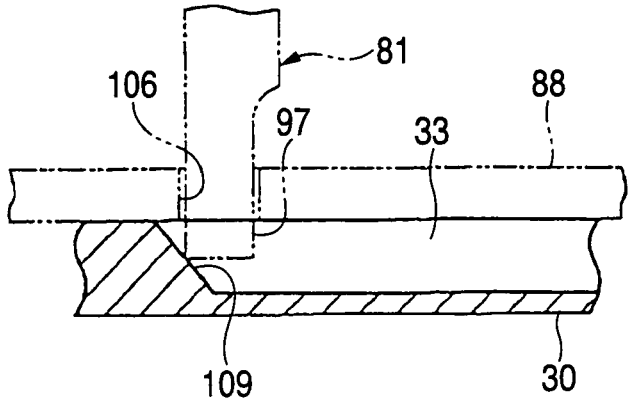
FIG. 26B is a sectional view of the first modified example of the manufacturing apparatus.

FIGS. 25 and 26 show a first modified example of an apparatus of fabricating a liquid ejection head.

In this case, an slope face 109 is formed at a longitudinal end portion of the elongated recess portion 33 and the punches 97 are pressed into the slope face 109. In order to form the slope face 109, an slope forming portion 53*b* by chamfering both longitudinal end portion of a distal end portion 53*a* of each projection 53 as shown in FIG. 25A. When the projection 53 is pressed into the chamber formation plate 30, the elongated recess portion 33 having the slope face 109 is formed at the longitudinal end portion. Relative positions of the punches 97 and the chamber formation plate 30 are set such that the punches 97 are pressed to the inclined plate 109 while the pressure generating forming plate 30 is supported at the predetermined position of the first die 79. The communicating port 34 is formed at the slope face 109 by lifting down the male die 81. Others are similar to the above-described embodiment and similar portions are designated with the same reference numerals.

The distal end portion of the punch 97 is pressed to the slope face 109 at the initial stage so that large bending moment is act on the punch 97. However, since the punches 97 are guided by the guide plate 88, the bending moment can firmly be received by the guide plate 88 so that the communicating port 34 can be formed without bringing about bending or escape at the punches 97 even in such a case. Further, the punch 97 is accurately pressed into the slope face 109, and the material flow smoothly accompanies with the punch 97. Therefore, burrs projecting into the elongated recess portion 33 can be prevented from being formed. Accordingly, bubbles in liquid flow will not stay in the flow path so that the ejection property of liquid ejection head can normally be maintained. Otherwise, the operation and the obtained advantages are similar to those of the above-described embodiment.

Since the elongated recess portion 33 is constituted by the V-shaped bottom faces, when the punch 97 having a rectangular cross section is pressed into the longitudinal end portion of the elongated recess portion 33, the distal end portion of the punch 97 is pressed onto both of the V-shaped bottom faces and the slope face 109 as shown in FIG. 26A. Therefore, the above-described burrs or the like can be prevented from being brought about also in the V-shaped bottom faces.

Figure 27:
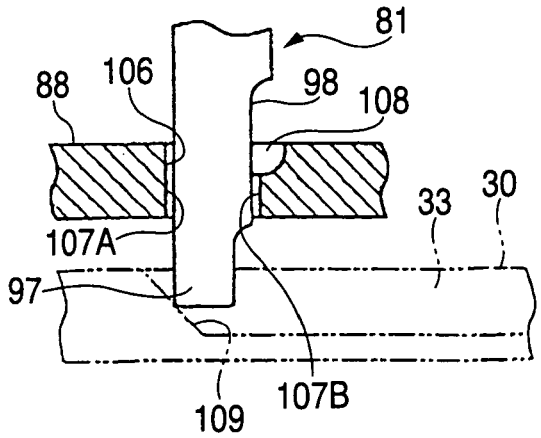
FIG. 27 is a section view for explaining a second modified example of the manufacturing apparatus.

FIG. 27 shows a second modified example of an apparatus of fabricating a liquid injection head.

In this case, the high rigidity portion 98 is guided by the guide plate 88. Others are similar to the above-described respective embodiments and similar portions are designated with the same reference numerals.

Since the high rigidity portion 98 having a relatively high rigidity is guided, the state of guiding the male die 81 is stabilized. Further, only a length of the punch 97 required for realizing the punching work may be ensured at the punch portion without ensuring a length required for guiding. Therefore, the length of the punches 97 can substantially be shortened and rigidity against bending or escape or the like of the punches 97 per se can be enhanced. Otherwise, the operation and the obtained advantages are similar to those of the above embodiments.

Meanwhile, the invention is not limited to the above-described embodiments but can variously be modified based on the description of the appended claims.

For example, with regard to the partition wall portion 28, when the proximal portion is more thick-walled than the distal end portion, the rigidity of the partition wall portion 28 can be increased and the volume necessary for the pressure related chamber 29 can be ensured. From the view point, the shape of the bottom of the elongated recess portion is not limited to V-shaped. For example, the bottom face of the elongated recess portion 33 may have an arcuate cross section. Further, in order to fabricate the elongated recess portion 33 having such a bottom shape, the first male die 51 having the projection 53 the distal end portion of which is arcuately chamfered.

With regard to the material for fabricating the chamber formation plate 30, in the view point of forming the proximal portion of the partition wall 28 to be thick-walled than the distal end portion, the material is not limited to that of a single metal plate. For example, a laminated plate material fabricated by laminating a plurality of plate materials may be used, and the chamber formation plate 30 may be fabricated by a coating plate coated with a resin on a surface of a metal board.

With regard to all the above-described plastic workings, in order to achieve desired accuracy, cold working is preferably performed. More preferably, temperature control is conducted such that temperature of a worked object falls within a constant range.

Further, with regard to a pressure generating element, an element other than the piezoelectric vibrator 10 may be adopted. For example, an electromechanical conversion element of an electrostatic actuator, a magnetorestrictive element or the like may be used. Further, a heat generating element may be used as a pressure generating element.

Figure 18:
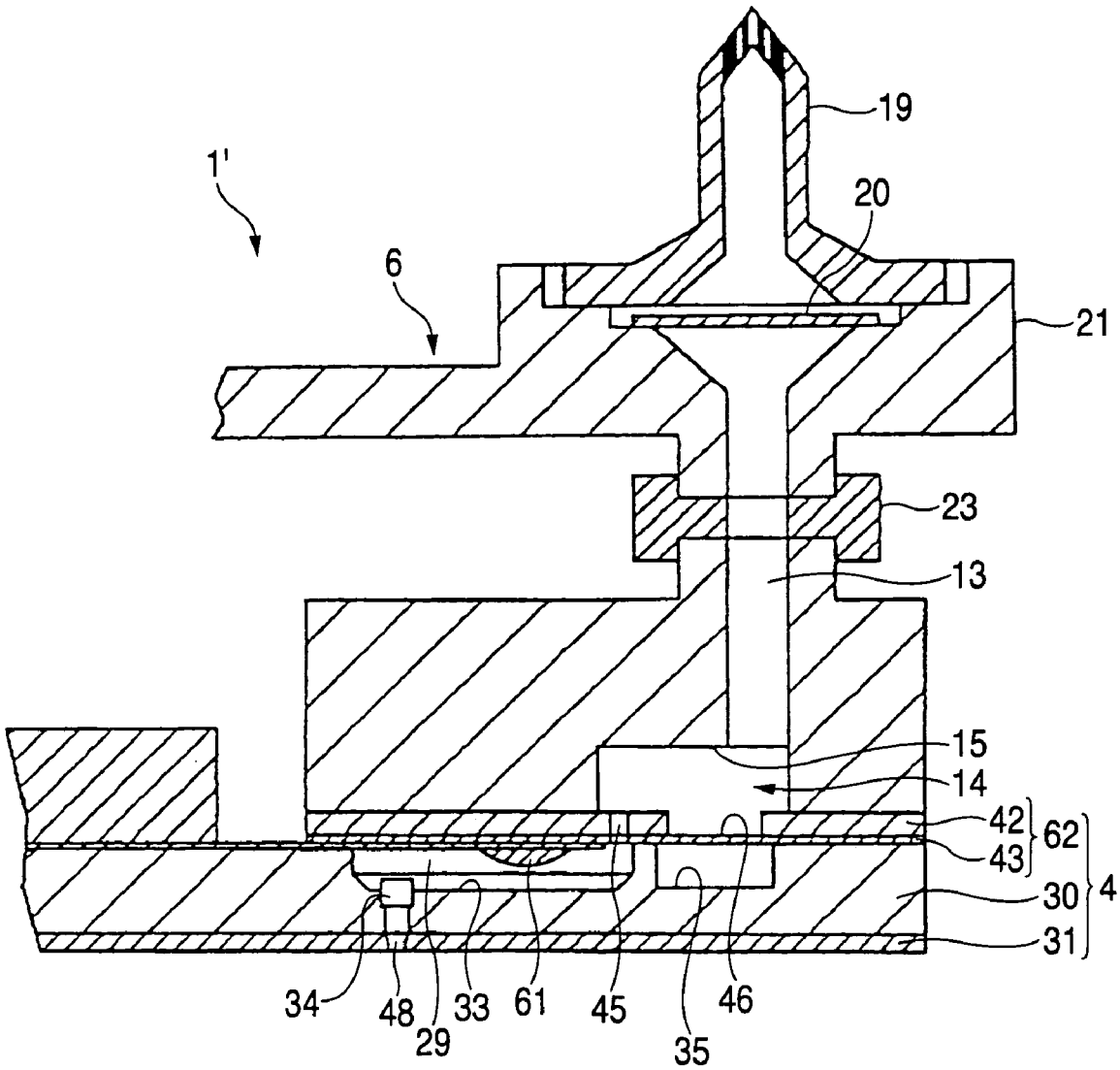
FIG. 18 is a sectional view for explaining an ink jet recording head according to a second example.

As a second example, a recording head 1' shown in FIG. 18 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

Further, the above-described punching method according to the invention is not limited to the application for the case of manufacturing a liquid ejection head.

What is claimed is:

1. A punching apparatus, comprising:

a male die, adapted to be opposed to a first face of a metallic plate member, the male die including a plurality of punches which are provided on the male die and arranged side by side in a first direction with a fixed pitch, the adjacent punches defining a gap therebetween, the gap continuing from a first side face that is a side face of one of the adjacent punches to a second side face that is a side face of the other of the adjacent punches in the first direction; and a guide member, formed with a guide face which supports a side portion of the male die, at least when the punches are pressed into the plate member in a second direction, to form through holes therein, the guide member formed with projections that support at least one of the first side face and the second side face between which the gap continues in the first direction.

2. The punching apparatus as set forth in claim 1, wherein the side portion of the male die extends in parallel with the first direction.

3. The punching apparatus as set forth in claim 1, wherein the punches are arranged on a base member which is actuated so as to collectively press the punches into the plate member.

4. The punching apparatus as set forth in claim 1, wherein:

each of the punches has a polygonal cross section including two sides which are parallel to the first direction; and side faces of each of the punches corresponding to the two sides are supported by the guide member.

5. The punching apparatus as set forth in claim 1, wherein the projections are arranged such that two adjacent punches are placed between two adjacent projections.

6. The punching apparatus as set forth in claim 5, wherein the projections are arranged such that at least one projection is placed between a gap defined in the two adjacent punches.

7. The punching apparatus as set forth in claim 1, wherein the guide face and the projections are formed by grinding work.

8. The punching apparatus as set forth in claim 4, wherein each of the punches has a rectangular cross section.

9. The punching apparatus as set forth in claim 1, wherein the fixed pitch is 0.3 mm or less.

10. The punching apparatus as set forth in claim 1, wherein a width of the hole is 0.2 mm or less.

11. The punching apparatus as set forth in claim 1, wherein the first face is a portion of the plate member which has been subjected to a plastic working.

12. The punching apparatus as set forth in claim 11, wherein the portion is a bottom face of a recess.

13. The punching apparatus as set forth in claim 1, wherein the punches are adapted to be pressed into the plate member comprised of nickel.

14. A punching apparatus as set forth in claim 12, wherein the bottom face is a slope face.

15. The punching apparatus as set forth in claim 1, wherein the projections are held in contact with the at least one of the first side face and the second side face.

16. The punching apparatus as set forth in claim 1, wherein the guide member comprises:

a first guide member; and a second guide member, separated from the first guide member, where the first and second guide members face each other via the punches.

17. A punching apparatus, comprising:

a first male die, adapted to be opposed to a first face of a metallic plate member, the first male die including a plurality of first punches which are provided on the first male die and arranged side by side in a first direction with a fixed pitch, a distal end of each of which has a tapered shape, the first male die for forming recessed portions on the first face of the plate member;

a second male die, adapted to be opposed to a first face of the plate member, the second male die including a plurality of second punches which are provided on the second male die and arranged side by side in the first direction with the fixed pitch; and a guide member, formed with a guide face which supports a side portion of the second male die, at least when the second punches are pressed into the plate member in a second direction, to form through holes therein, wherein the second male die includes a first die for forming unpenetrated holes in the first face of the plate member, and a second die for punching the unpenetrated holes to form through holes communicated with a second face of the plate member which is opposite to the first face.

18. The punching apparatus as set forth in claim 17, wherein a ratio of a distance between the first face and the second face with respect to a width of the hole is 0.5 or more.

19. A punching apparatus, comprising:

a male die, adapted to be opposed to a first face of a metallic plate member, the male die including a plurality of punches which are provided on the male die and arranged side by side in a first direction with a fixed pitch, the adjacent punches defining a gap therebetween; and a guide member, formed with a guide face which supports a side portion of the male die, at least when the punches are pressed into the plate member in a second direction, to form through holes therein, the guide member formed with projections that support at least one side face of each of the punches which faces the gap, wherein the guide member is arranged movably in the second direction.

20. The punching apparatus as set forth in claim 19, wherein:

the guide member is formed with a first face, a second face, and a through hole which communicates the first face and the second face;

the male die is inserted from an opening of the though hole at the first face, and allowed to move therein in the second direction; and an inner face of the through hole serves as the guide face.

21. The punching apparatus as set forth in claim 20, wherein the second face of the guide member is brought into contact with the plate member, so that the punches are projected from an opening of the through hole at the second face when the through holes are formed.

22. The punching apparatus as set forth in claim 21, wherein the guide member is arranged such that distal end face of the punches and the second face of the guide member are made flush with each other, before the second face is brought into contact with the plate member.

23. A punching apparatus, comprising:

a male die, adapted to be opposed to a first face of a metallic plate member, the male die including a plurality of punches which are provided on the male die and arranged side by side in a first direction with a fixed pitch, the adjacent punches defining a gap therebetween;

a guide member, formed with a guide face which supports a side portion of the male die, at least when the punches are pressed into the plate member in a second direction, to form through holes therein, the guide member formed with projections that support at least one side face of each of the punches which faces the gap, wherein the punches are arranged on a base member which is actuated so as to collectively press the punches into the plate member; and a fixation member, to which the male die is fixed, wherein:

the base member includes a first part integrated with the punches, and a second part continued from the first part and fixed at the fixation member;

the first part has a higher rigidity than a rigidity of the punches, wherein, in parallel with the first direction, a first cross sectional area of the first part is larger than a cross sectional area of the punches; and the second part has a second cross sectional area in parallel with the first direction which is larger than the first cross sectional area.

24. The punching apparatus as set forth in claim 23, wherein the guide member supports the first part of the base member.

25. The punching apparatus as set forth in claim 23, wherein the fixation member is formed with a retainer which restricts a movement of the second part of the base member in the second direction.

26. A punching apparatus, comprising:

a male die, adapted to be opposed to a first face of a metallic plate member, the male die including a plurality of punches which are provided on the male die and arranged side by side in a first direction with a fixed pitch, the adjacent punches defining a gap therebetween; and a guide member, formed with a guide face which supports a side portion of the male die, at least when the punches are pressed into the plate member in a second direction, to form through holes therein, the guide member formed with projections that support at least one side face of each of the punches which faces the gap, wherein the guide member is formed with a step portion which supports at least one side face of the outermost punches in the first direction, which is opposed to the gap.

27. A punching apparatus, comprising:

a male die, adapted to be opposed to a first face of a metallic plate member, the male die including a plurality of punches which are provided on the male die and arranged side by side in a first direction with a fixed pitch, the adjacent punches defining a gap therebetween; and a guide member, formed with a guide face which supports a side portion of the male die, at least when the punches are pressed into the plate member in a second direction, to form through holes therein, the guide member formed with projections that support at least one side face of each of the punches which faces the gap, wherein the guide member comprises:

a first guide member; and a second guide member, separated from the first guide member, where the first and second guide members face each other via the punches, and wherein each of the first guide member and the second guide member is formed with the projections.

28. The punching apparatus as set forth in claim 27, wherein each of the first guide member and the second guide member is formed with a step portion that supports at least one side face of the outermost punches in the first direction, which is opposed to the gap.

29. The punching apparatus as set forth in claim 27, wherein the projections are arranged such that two adjacent punches are placed between two adjacent projections.

30. The punching apparatus as set forth in claim 29, wherein the projections of the first guide member do not face the projections of the second guide member.

31. The punching apparatus as set forth in claim 29, wherein the projections are arranged such that at least one projection is placed in a gap defined between the two adjacent punches.

* * * * *